US010774593B2

(12) United States Patent
Qin et al.

(10) Patent No.: US 10,774,593 B2
(45) Date of Patent: Sep. 15, 2020

(54) SEALING ELEMENTS FOR ROLLER CONE BITS

(71) Applicant: Halliburton Energy Services, Inc., Houston, TX (US)

(72) Inventors: Shiwei Qin, Conroe, TX (US); Douglas Bruce Caraway, Conroe, TX (US); Micheal Burl Crawford, Willis, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 63 days.

(21) Appl. No.: 16/090,887

(22) PCT Filed: May 20, 2016

(86) PCT No.: PCT/US2016/033492
§ 371 (c)(1),
(2) Date: Oct. 3, 2018

(87) PCT Pub. No.: WO2017/200552
PCT Pub. Date: Nov. 23, 2017

(65) Prior Publication Data

US 2019/0119987 A1 Apr. 25, 2019

(51) Int. Cl.
*E21B 10/24* (2006.01)
*E21B 10/25* (2006.01)

(52) U.S. Cl.
CPC ..... *E21B 10/24* (2013.01); *E21B 10/25* (2013.01)

(58) Field of Classification Search
CPC ..... E21B 10/24; E21B 10/23; E21B 10/25; E21B 2010/243; E21B 2010/225
(Continued)

(56) References Cited

U.S. PATENT DOCUMENTS 4,613,141 A * 9/1986 Heinen ..... F16J 15/162 277/359
6,290,235 B1 * 9/2001 Albertson ..... F16J 15/002 277/510

(Continued)

FOREIGN PATENT DOCUMENTS

CN 10266123 9/2012
CN 104948114 9/2015

OTHER PUBLICATIONS

International Search Report and Written Opinion for PCT/US2016/033492 dated Feb. 15, 2017.

(Continued)

*Primary Examiner* — Nathan Cumar
(74) *Attorney, Agent, or Firm* — Thomas Rooney; C. Tumey Law Group PLLC

(57) ABSTRACT

A seal assembly includes a seal groove defined at least partially between a first member and a second member rotatable relative to the first member, an annular sealing element positioned in the seal groove and providing a mud surface, a lubricant surface axially opposite the mud surface, an inner radial surface, and an outer radial surface radially opposite the inner radial surface. One of the inner and outer radial surfaces is a dynamic surface that seals against the first member when the sealing element rotates with the second member, or seals against the second member when the second member rotates relative to the sealing element. A lubricant channel is defined through the sealing element and extending between the lubricant surface and the dynamic surface to provide a lubricant to the dynamic surface.

28 Claims, 13 Drawing Sheets

(58) Field of Classification Search
USPC ..... 277/336
See application file for complete search history.

(56) References Cited

U.S. PATENT DOCUMENTS

| | | | | |
|---|---|---|---|---|
| 7,036,613 | B2 | 5/2006 | Burr | |
| 2008/0099244 | A1* | 5/2008 | Chellappa | E21B 10/25 175/57 |
| 2008/0257610 | A1* | 10/2008 | Koltermann | E21B 10/25 175/371 |
| 2011/0297448 | A1* | 12/2011 | Lu | E21B 10/25 175/371 |

OTHER PUBLICATIONS

Chinese Search Report for Application No. 2016800838529 dated May 24, 2019.

* cited by examiner

SEALING ELEMENTS FOR ROLLER CONE BITS

BACKGROUND

Several types of drill bits can be used to drill a wellbore for hydrocarbon extraction or for any other purpose. One type of drill bit is a roller cone bit, alternately referred to as a rotary cone bit or a rock bit. Briefly, roller cone bits commonly include a plurality of cutter cone assemblies (typically three) rotatably coupled to a bit body. As the bit body is rotated about its central axis, the cutter cone assemblies cooperatively grind and crush underlying rock to form a wellbore.

Roller cone bits also typically include an internal lubrication system that uses a fairly viscous lubricant. The lubricant is retained within the lubrication system using one or more sealing elements strategically positioned in each cutter cone assembly. The sealing elements prevent the migration of fluids and/or debris into the interior portions of the cutter cone assemblies, which could otherwise contaminate vital bearing surfaces and thereby reduce the operational lifespan of the roller cone bit.

Such sealing elements can wear rather rapidly because of the harsh and abrasive environments in which roller cone bits commonly operate. For instance, during operation the sealing elements are commonly subjected to drilling fluids, which can contain fine abrasive particulates, such as bentonite and drill cuttings. The sealing elements are also commonly subjected to high temperatures, large pressure fluctuations, and dynamic movement between the cutter cone assemblies and the bit body. A good sealing element design must have the ability to continue to perform its sealing function under these harsh and abrasive environments with a low leakage rate, and the design must also preferably offer an extended service life.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

This present disclosure is related to roller cone drill bits and, more particularly, to sealing elements that are ported to provide lubrication to a dynamic seal surface during operation. The embodiments discussed herein describe a sealing element used to seal between a stationary first member and a dynamic (rotating) second member. The first member, for instance, can be a journal in a cutter cone assembly, and the second member can be a roller cone rotatably mounted to the journal. A seal groove is defined at least partially between the first and second members and the sealing element is positioned in the seal groove. The sealing element provides an annular body that has a first axial surface, a second axial surface opposite the first axial surface, an inner radial surface, and an outer radial surface opposite the inner radial surface. In some embodiments, the second axial side comprises a lubricant surface and the inner radial surface comprises a dynamic surface that seals against the first member as the sealing element rotates with the second member. In other embodiments, however, the inner radial surface comprises the lubricant surface and the first axial side comprises the dynamic surface. An inlet aperture may be defined on the lubricant surface, an outlet aperture may be defined on the dynamic surface, and a lubricant channel is defined through the sealing element and extends between the inlet and outlet apertures to provide a lubricant to the dynamic surface. The lubricant channel may be in fluid communication with a lubricant chamber and is, therefore, able to maintain constant lubrication of the dynamic surface, which may improve the operational lifespan of the sealing element.

Figure 1:
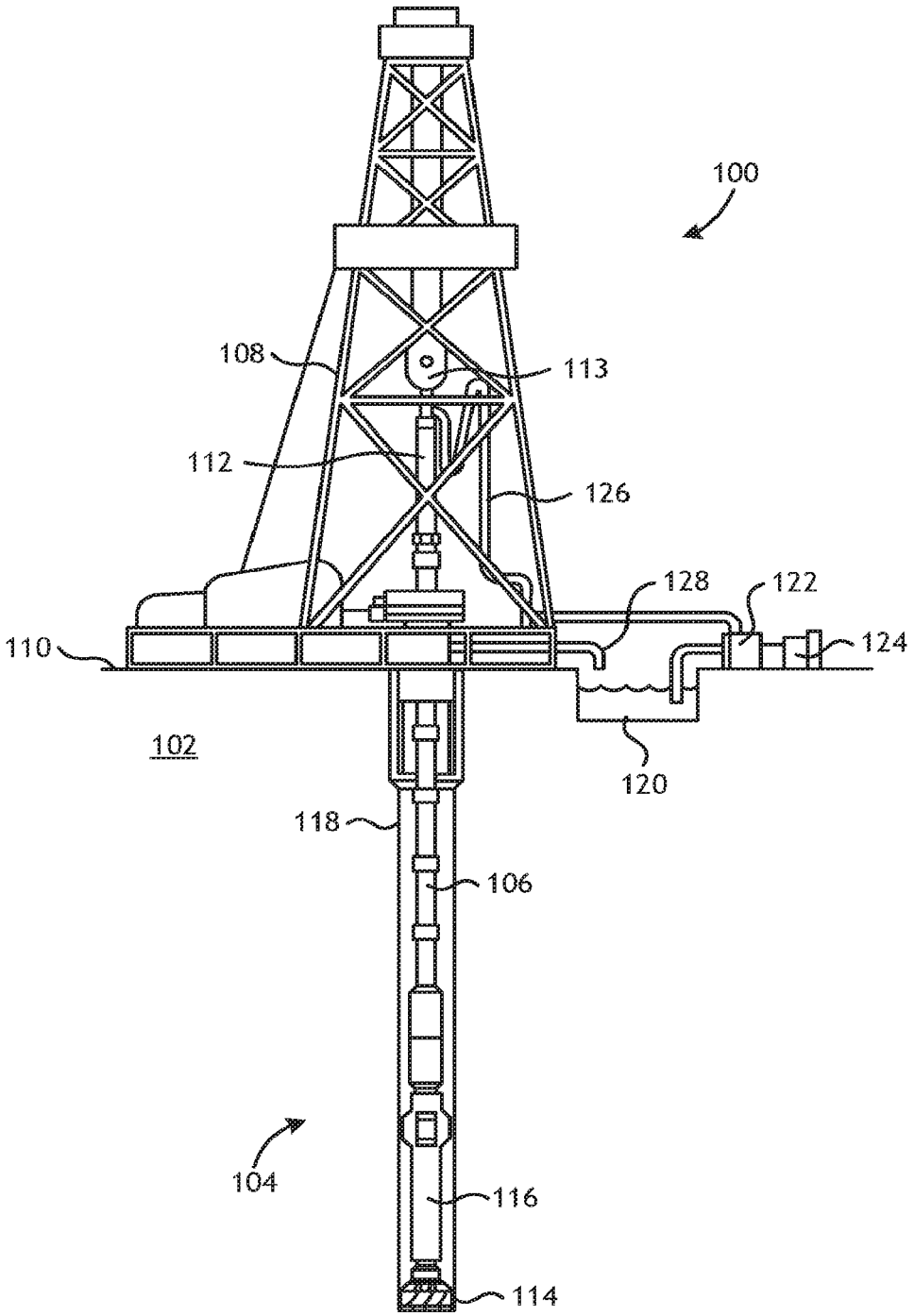
FIG. 1 is an example drilling system that may employ the principles of the present disclosure.

FIG. 1 is an example drilling system 100 that may employ one or more principles of the present disclosure. Boreholes may be created by drilling into the earth 102 using the drilling system 100. The drilling system 100 may include and drive a bottom hole assembly (BHA) 104 positioned or otherwise arranged at the bottom of a drill string 106 extended into the earth 102 from a derrick 108 arranged at the surface 110. The derrick 108 includes a kelly 112 and a traveling block 113 used to lower and raise the kelly 112 and the drill string 106.

The BHA 104 includes a drill bit 114 operatively coupled to a tool string 116, which is moved axially within a drilled wellbore 118 as attached to the drill string 106. The drill bit 114 used to form the wellbore 118 can take on several designs or configurations. One example of the drill bit 114 is a roller cone bit, also commonly referred to as a rotary cone or rock bit. During operation, the drill bit 114 penetrates the earth 102 and thereby creates the wellbore 118. The BHA 104 provides directional control of the drill bit 114 as it advances into the earth 102. The tool string 116 can be semi-permanently mounted with various measurement tools (not shown) such as, but not limited to, measurement-while-drilling (MWD) and logging-while-drilling (LWD) tools, that may be configured to take downhole measurements of drilling conditions.

Drilling fluid or "mud" from a mud tank 120 may be pumped downhole using a mud pump 122 powered by an adjacent power source, such as a prime mover or motor 124. The drilling fluid may be pumped from the mud tank 120, through a standpipe 126, which feeds the drilling fluid into the drill string 106 and conveys the same to the drill bit 114. The drilling fluid exits one or more nozzles arranged in the drill bit 114 and in the process cools the drill bit 114. After exiting the drill bit 114, the drilling fluid circulates back to the surface 110 via the annulus defined between the wellbore 118 and the drill string 106, and in the process returns drill cuttings and debris to the surface. The cuttings and drilling fluid mixture are passed through a flow line 128 and are processed such that a cleaned drilling fluid is returned down hole through the standpipe 126 once again.

Although the drilling system 100 is shown and described with respect to a rotary drill system in FIG. 1, those skilled in the art will readily appreciate that many types of drilling systems can be employed in carrying out embodiments of the disclosure. For instance, drills and drill rigs used in embodiments of the disclosure may be used onshore (as depicted in FIG. 1) or offshore (not shown). Offshore oilrigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, casing drilling strings, liner drilling strings, pipe in pipe drilling systems, coil tubing drilling systems, etc., without departing from the scope of the disclosure.

Figure 2A:
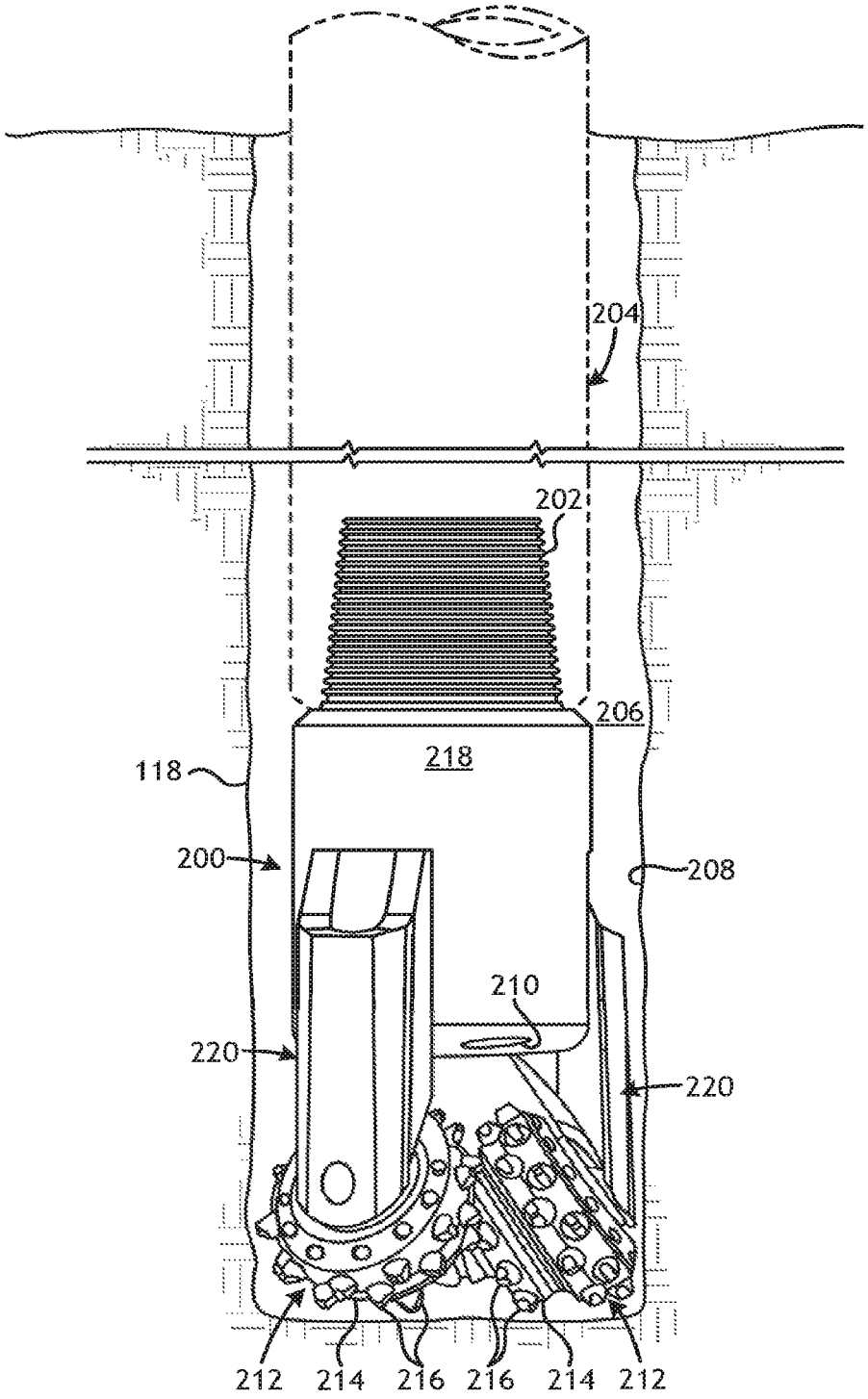
FIGS. 2A and 2B are views of an example roller cone drill bit that may incorporate the principles of the present disclosure.

FIG. 2A is a plan view of an example roller cone drill bit 200 that may incorporate the principles of the present disclosure. The drill bit 200 may be the same as or similar to the drill bit 114 of FIG. 1 and, therefore, may be used to drill the wellbore 118. As illustrated, the drill bit 200 may include a threaded pin connection 202 used to attach the drill bit 200 to a drill string 204 and, more particularly, to the BHA 104 (FIG. 1). The pin connection 202 and the corresponding threaded connections of the drill string 204 are designed to allow rotation of the drill bit 200 in response to rotation of the drill string 204.

As the drill bit 200 operates, an annulus 206 is formed between the exterior of the drill string 204 and an inner wall 208 of the wellbore 118. In addition to rotating the drill bit 200, the drill string 204 may also be used as a conduit for communicating drilling fluid ("mud") from the well surface to the drill bit 200 at the bottom of the wellbore 118. The drilling fluid may be ejected out of the drill bit 200 via various nozzles 210 provided in the drill bit 200. Cuttings generated by the drill bit 200 and other debris at the bottom of the wellbore 118 will mix with the drilling fluid exiting the nozzles 210 and return to the well surface via the annulus 206.

Cutting, grinding, and/or drilling action of the drill bit 200 occurs as one or more cutter cone assemblies 212 are rolled around the bottom of the wellbore 118 by rotation of the drill string 204. The cutter cone assemblies 212 cooperate with each other to form the wellbore 118 in response to rotation of the drill bit 200. Each cutter cone assembly 212 may include cutting edges 214 with protruding inserts 216 configured to scrape and gouge the sides and bottom of the wellbore 118 in response to the weight and rotation applied to the drill bit 200 from the drill string 204.

The drill bit 200 may include a one-piece or unitary bit body 218 and one or more support arms 220 (typically three) angularly spaced from each other about the periphery of the bit body 218.

Figure 2B:
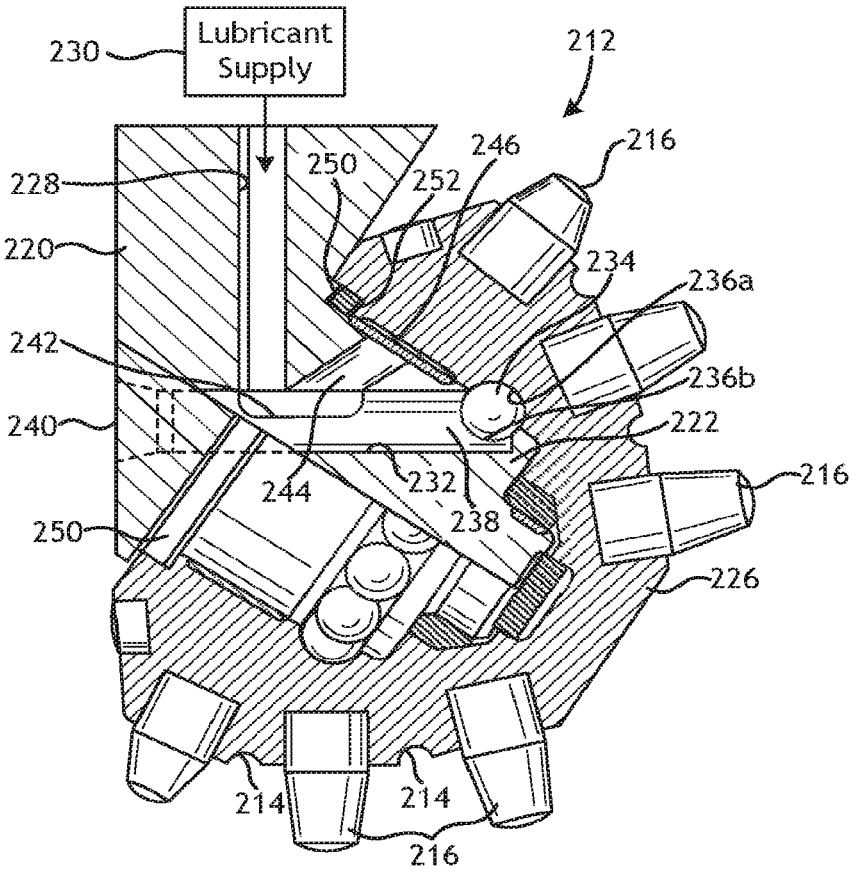

FIG. 2B is a partial cross-sectional side view of one of the cutter cone assemblies 212 mounted to a corresponding support arm 220. Each support arm 220 includes a journal 222 that extends from the respective support arm 220. Each cutter cone assembly 212 is configured to be mounted on its associated journal 222 in a substantially identical manner. Accordingly, only one support arm 220 and cutter cone assembly 212 are described herein since the same description applies generally to the other support arms 220 and their associated cutter cone assemblies 212.

The cutter cone assembly 212 includes a roller cone 226 that, as illustrated, may exhibit a generally frustoconical shape. The roller cone 226 defines an internal cavity configured to receive the journal 222 to mount the roller cone 226 on the journal 222. The journal 222 may be angled downwardly and inwardly with respect to the projected axis of rotation of the drill bit 200. This orientation of the journal 222 results in the roller cone 226 and the associated cutting edges 214 and inserts 216 engaging the side and bottom of the wellbore 118 during drilling operations.

A lubricant passage 228 is defined in the support arm 220 and is in communication with a lubricant supply 230. The journal 222 may include a plurality of bearing systems and assemblies that support the roller cone 226 and maintain it against separation from the journal 222. For example, the journal 222 may define a bearing insert bore 232 in fluid communication with the lubricant passage 228. Ball bearings 234 may be inserted through the bearing insert bore 232 and into engagement with an outer bearing race **236*b* defined on the inner wall of the roller cone 226. Thereafter, a ball plug 238 may be extended into the bearing insert bore 232 to engage an inner bearing race 236*a* against the ball bearings 234. The ball plug 236 may be secured in immovable relation to the journal 222 by means of a weld connection 240, for example. The ball bearings 234 provide rotatable bearing support of the roller cone 226 relative to the journal 222**.

The ball plug 238 may define a lubricant depression or groove 242 configured to convey lubricant to the ball bearings 234 from the lubricant passage 228. The groove 242 may also fluidly communicate with a lubricant branch passage 244 defined in the journal 222. The lubricant branch passage 244 may help convey lubricant to a bearing interface defined between opposing hardened cylindrical surfaces 246 of the roller cone 226 and the journal 222, respectively, thus providing a film of lubricant between these relative movable surfaces.

The lubricant branch passage 244 may also help convey lubricant to a sealing element 250 positioned within a seal groove 252 and interposing the roller cone 226 and the journal 222. In some embodiments, the seal groove 252 may be defined in the roller cone 226, but may alternatively be formed in the journal 222. In other embodiments, as illustrated, the journal 222 and the roller cone 226 may jointly define portions of the seal groove 252. The sealing element 250 may be configured to prevent the migration of fluids and/or debris into the interior of the roller cone 226, which could otherwise contaminate the bearing surfaces of the cutter cone assembly 212.

In accordance with the present disclosure, and as is described below, the sealing element 250 may include one or more lubricant channels that convey lubrication or "grease" originating from the lubricant supply 230 to a dynamic surface of the sealing element 250. As used herein, the term "dynamic surface" refers to a surface of the sealing element 250 that seals against an opposing stationary surface of the seal groove 252 as the sealing element 250 rotates, or otherwise refers to a surface of the sealing element 250 that seals against an opposing dynamic (i.e., displacing or rotating) surface of the seal groove 252 as the opposing dynamic surface rotates. As described herein, the dynamic surface of the sealing element 250 maintains constant lubrication of the opposing stationary or dynamic surface and thereby improves the life of the sealing element 250.

The drill bit 200 and its foregoing description are merely provided for illustrative purposes in explaining the principles of the present disclosure. Those skilled in the art will readily recognize that other types and designs of roller cone drill bits and numerous structural variations and different configurations of the drill bit 200 may be employed, without departing from the scope of the disclosure. Accordingly, the foregoing description of the drill bit 200 should not be considered limiting to the scope of the present disclosure.

Figure 2C:
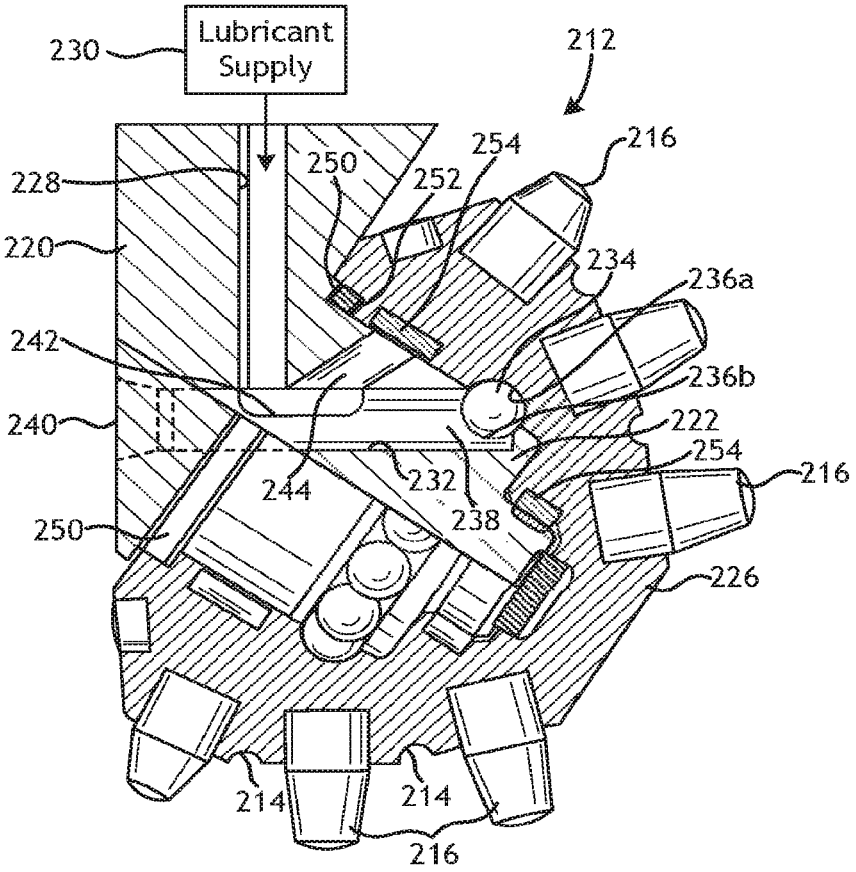
FIG. 2C is another embodiment of the cutter cone assembly of FIG. 2B.

FIG. 2C, for example, is a partial cross-sectional side view of another type of cutter cone assembly 212 mounted to the journal 222 and able to utilize the principles of the present disclosure. In contrast the cutter cone assembly 212 of FIG. 2B, the cutter cone assembly 212 of FIG. 2C includes one or more sets of roller bearings 254 used to help facilitate rolling engagement between the roller cone 226 and the journal 222. While only two sets of roller bearings 254 are shown in FIG. 2C, it will be appreciated that more (or less) than two sets may be employed, without departing from the scope of the disclosure. The lubricant passage 228 may be in fluid communication with the roller bearings 254 via the bearing insert bore 232 and the lubricant branch passage 244 to help convey lubricant to the roller bearings 254.

Figure 3:
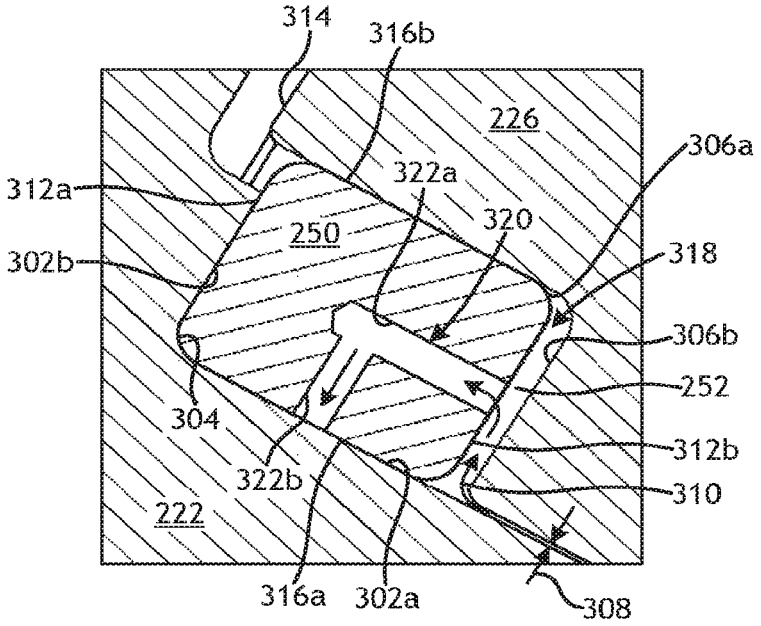
FIG. 3 is an enlarged cross-sectional side view of a portion of the drill bit of FIG. 2B showing an example embodiment of a sealing element.

FIG. 3 is an enlarged cross-sectional side view of a portion of the drill bit 200 showing an example embodiment of the sealing element 250 positioned within the seal groove 252. In the illustrated embodiment, the seal groove 252 is cooperatively defined by the journal 222 and the roller cone 226. More specifically, the journal 222 provides a first journal surface 302*a* and a second journal surface 302*b*, where the second journal surface 302*b* extends generally perpendicular to the first journal surface 302*a* but may alternatively extend at any angle therefrom. In some embodiments, as illustrated, the seal groove 252 may define a radiused journal surface 304 that provides a transition between the first and second journal surfaces 302*a,b*. Furthermore, the roller cone 226 provides a first cone surface 306*a* and a second cone surface 306*b*, where the second cone surface 306*b* extends generally perpendicular to the first cone surface 306*a* but may alternatively extend at any angle therefrom. Accordingly, the first and second journal surfaces 302*a,b* and the first and second cone surfaces 306*a,b* may cooperatively define the seal groove 252.

A small gap 308 is defined between the journal 222 and the roller cone 226 and allows the roller cone 226 to rotate relative to the journal 222 during operation. A lubricant 310 (alternately referred to as "grease") is pumped into the gap 308 to lubricate the interface between the journal 222 and the roller cone 226. The lubricant 310 may originate from the lubricant supply 230 (FIG. 2B) and may be fed into the gap 308 via the lubricant passage 228 (FIG. 2B) and the lubricant branch passage 244 (FIG. 2B). The gap 308 may also facilitate a conduit or pathway for the lubricant 310 to infiltrate and otherwise enter the seal groove 252 and thereby provide lubrication for the dynamic sealing engagement provided by the sealing element 250.

The sealing element 250 generally comprises an annular (i.e., ring-shaped) structure having opposing axial ends in the form of a first axial surface 312*a* and a second axial surface 312*b* opposite the first axial surface 312*a*. The first and second axial surfaces 312*a,b* generally refer to the axial ends or sides of the sealing element 250. During operation, the first axial surface 312*a* will be exposed to debris and contaminant-laden fluids via an external separation 314 between the journal 222 and the roller cone 226. Accordingly, the first axial surface 312*a* is often referred to and otherwise characterized as a "mud surface." In contrast, the second axial surface 312*b* will be exposed to the lubricant 310 entering the seal groove 252 via the gap 308. Accordingly, the second axial surface 312*b* is often referred to and otherwise characterized as a "lubricant surface." In at least one embodiment, however, more than one sealing element may be arranged within the seal groove 252. In such embodiments, the first axial surface 312*a* may not necessarily be exposed to debris and contaminant-laden fluids, but may instead be arranged axially adjacent another sealing element.

The sealing element 250 also includes opposing inner and outer diameters in the form of an inner radial surface 316*a* and an outer radial surface 316*b*. The sealing element 250 of FIG. 3 is configured as a radial seal where the inner and outer radial surfaces 316*a,b* provide sealed interfaces during operation. More specifically, the inner radial surface 316*a* is configured to sealingly engage the first journal surface 302*a*, while the outer radial surface 316*b* is configured to sealingly engage the first cone surface 306*a*. The sealing element 250 is maintained under sufficient compression to thereby ensure maintenance of a seal at the interface between the inner radial surface 316*a* and the first journal surface 302*a* and the interface between the outer radial surface 316*b* and the first cone surface 306*a*.

In embodiments where the sealing element 250 rotates with the roller cone 226 relative to the journal 222, the inner radial surface 316*a* will be characterized as the "dynamic surface." In contrast, in embodiments where the sealing element 250 remains stationary with the journal 222 relative to the roller cone 226, the outer radial surface 316*b* will be characterized as the "dynamic surface." For purposes of the following description, however, it will be assumed that the sealing element 250 rotates with the roller cone 226 relative to the journal 222 and, therefore, the inner radial surface 316*a* will be referred to herein as the "dynamic surface 316*a*." It will be appreciated, however, that the principles of the present disclosure are equally applicable to embodiments where the outer radial surface 316*b* serves as the dynamic surface, without departing from the scope of the disclosure.

The sealing element 250 may be made of a variety of pliable or flexible materials including, but not limited to, elastomers, thermoplastics, and thermosets. Suitable elastomers that may be used for the sealing element 250 include, for example, nitrile butadiene (NBR) which is a copolymer of acrylonitrile and butadiene, carboxylated acrylonitrile butadiene (XNBR), butyl rubber, nitrile rubber, hydrogenated acrylonitrile butadiene (HNBR) which is commonly referred to as highly saturated nitrile (HSN), carboxylated hydrogenated acrylonitrile butadiene (XHNBR), hydrogenated carboxylated acrylonitrile butadiene (HXNBR), halogenated butyl rubbers, styrene-butadiene rubber, ethylene propylene rubber, ethylene propylene diene rubber, epichlorohydrin rubber, polyacrylic rubber, silicone rubber, fluorosilicone rubber, chloroprene rubber, polysulfide rubber, ethylene propylene (EPR), ethylene propylene diene (EPDM), tetrafluoroethylene and propylene (FEPM), fluorocarbon (FKM), perfluoroelastomer (FEKM), natural polyisoprene, synthetic polyisoprene, polybutadiene, polychloroprene, neoprene, baypren, fluoroelastomers, perfluoroelastomers, polyether block amides, chlorosulfonated polyethylene, ethylene-vinyl acetate, thermoplastic elastomers, resilin, elastin, combinations thereof, and the like.

Suitable thermoplastics that may be used for the sealing element 250 include, for example, polyphenylene sulfide (PPS), polyetheretherketones (e.g., PEEK, PEK and PEKK), and polytetrafluoroethylene (PTFE). Suitable thermosets that may be used for the sealing element 250 include, for example, epoxies and phenolics.

In some embodiments, the sealing element 250 may be made of a composite material including a nonelastomeric component bonded to a rubber matrix. One example nonelastomeric component is in the form of fibers such as those selected from the group consisting of polyester fiber, cotton fiber, stainless steel fibers aromatic polyamines (Aramids) such as those available under the Kevlar family of compounds, polybenzimidazole (PBI) fiber, poly m-phenylene isophthalamide fiber such as those available under the Nomex family of compounds, and mixtures or blends thereof such as PBI/Kevlar/stainless steel staple fabric. The fibers either can be used in their independent state and/or combined with an elastomeric composite component, or may be combined into threads or woven into fabrics with or without an elastomeric composite component. Other composite materials suitable for use in forming the sealing element 250 include those that display properties of high-temperature stability and endurance, wear resistance, and have a coefficient of friction similar to that of the polymeric material specifically mentioned above. If desired, glass fiber can be used to strengthen the polymeric fiber, in such case constituting the core for the polymeric fiber.

In some embodiments, as illustrated, the second axial surface 312*b* may be spaced from the second cone surface 306*b* and thereby define a lubricant chamber 318 within the seal groove 252. During operation, the lubricant 310 may be pumped or otherwise migrate into and fill the lubricant chamber 318. The lubricant 310 may be used to lubricate the interface between the dynamic surface 316*a* and the first journal surface 302*a*, and thereby prolong the life of the sealing element 250.

According to embodiments of the present disclosure, the sealing element 250 may provide and otherwise define a lubricant channel 320 that extends between the second axial surface 312*b* and the dynamic surface 316*a*. The lubricant channel 320 may be machined into the sealing element 250 or may alternatively be molded into the sealing element 250 during manufacture. The lubricant channel 320 may provide a fluid passageway or conduit configured to convey the lubricant 310 from the lubricant chamber 318 directly to the interface between the dynamic surface 316*a* and the first journal surface 302*a* and at an axial location between the first axial surface 312*a* and the second axial surface 312*b*.

In the illustrated embodiment, an axial channel 322*a* and a radial channel 322*b* jointly define the lubricant channel 320. The axial channel 322*a* extends from the second axial surface 312*b* and the radial channel 322*b* extends from the dynamic surface 316*a* and is substantially perpendicular to the axial channel 322*a*. The axial and radial channels 322*a,b* intersect at a location within the interior of the sealing element 250 to facilitate fluid communication from the lubricant chamber 318 to the dynamic surface 316*a*. As will be appreciated, several variations and designs of the sealing element 250 and the lubricant channel 320 may be employed without departing from the scope of the disclosure. The following figures and discussion provide various contemplated designs and configurations for the sealing element 250 and the lubricant channel 320, but should not be considered as limiting the scope of the disclosure. Rather, those skilled in the art will readily recognize that other designs and configurations could equally be used in keeping with the principles described herein.

Figure 4A:
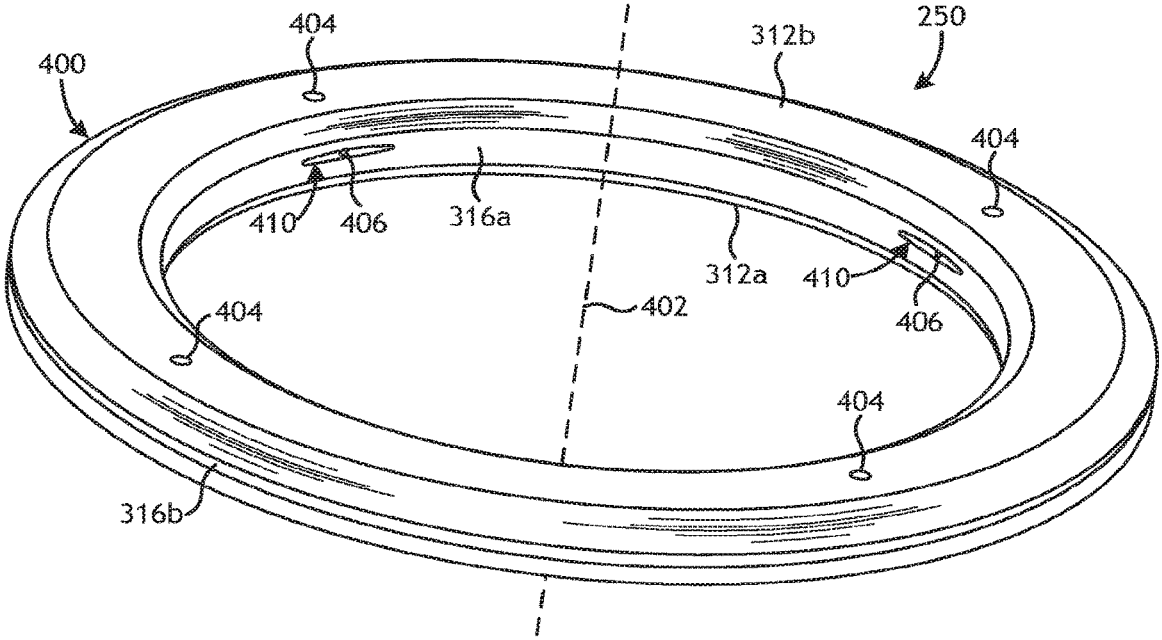
FIGS. 4A-4E are various views of the sealing element of FIGS. 2B and 3.

FIGS. 4A-4E are various views of the sealing element 250 of FIGS. 2B and 3, according to one or more embodiments. As illustrated in FIG. 4A, the sealing element 250 may comprise an annular body 400 that defines and otherwise provides the opposing first and second axial surfaces 312*a,b*, the dynamic surface 316*a*, and the outer radial surface 316*b*. The annular body 400 also provides a central axis 402.

One or more inlet apertures 404 (four shown in FIG. 4A) may be defined in the second axial surface 312*b* and one or more outlet apertures 406 (two shown in FIG. 4A) may be defined in the dynamic surface 316*a*. Each inlet and outlet aperture 404, 406 provides access into a corresponding channel 320 (FIGS. 4B, 4C, and 4E) extending between the second axial surface 312*b* and the dynamic surface 316*a*.

Figure 4B:
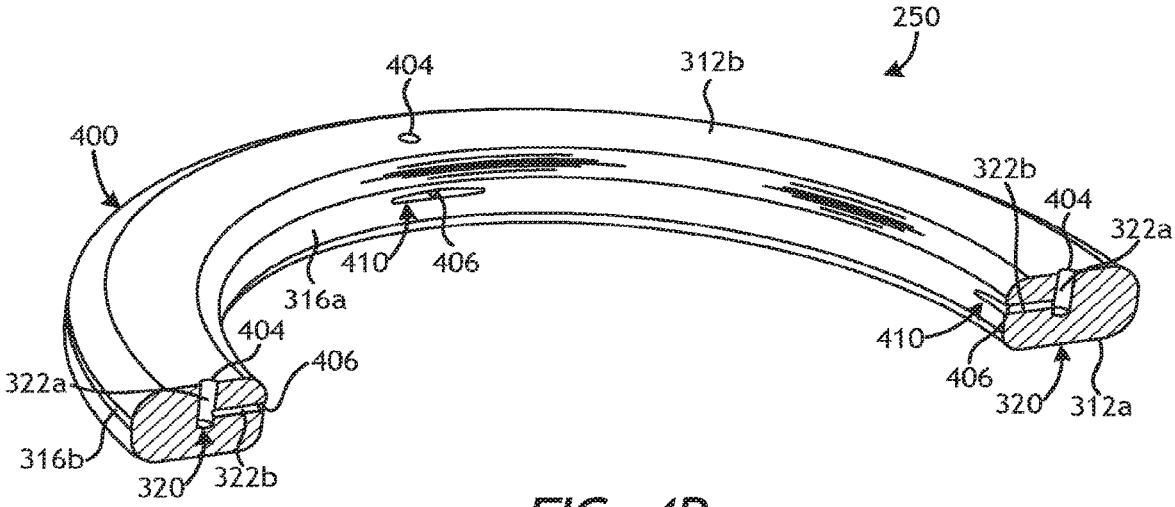
Figure 4C:
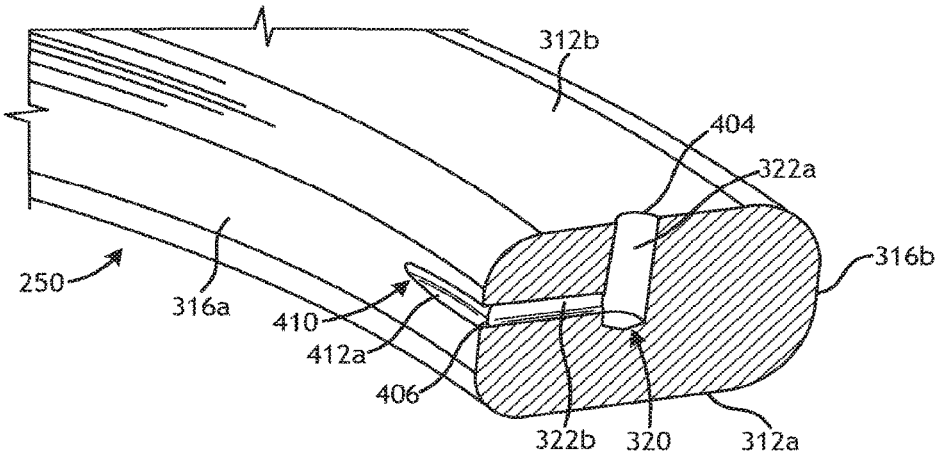

FIG. 4B is a partial cross-sectional view of the sealing element 250 as taken through angularly opposite channels 320, and FIG. 4C is an enlarged cross-sectional view of the sealing element 250 as taken through one of the channels 320. Each lubricant channel 320 includes the axial channel 322*a* extending from the second axial surface 312*b* and the radial channel 322*b* extending from the dynamic surface 316*a* and intersecting at a location within the interior of the sealing element 250 to facilitate fluid communication from the lubricant chamber 318 (FIG. 3) to the dynamic surface 316*a*. In some embodiments, the axial channel 322*a* may extend from the dynamic surface 316*a* at an angle substantially parallel to the central axis 402 (FIG. 4A), and the radial channel 322*b* may extend substantially perpendicular to the axial channel 322*a* and the central axis 402. It will be appreciated, however, that the axial and radial channels 322*a,b* may alternatively extend at various other angles and nonetheless provide fluid communication between the second axial surface 312*b* and the dynamic surface 316*a*, without departing from the scope of the disclosure.

Figure 4D:
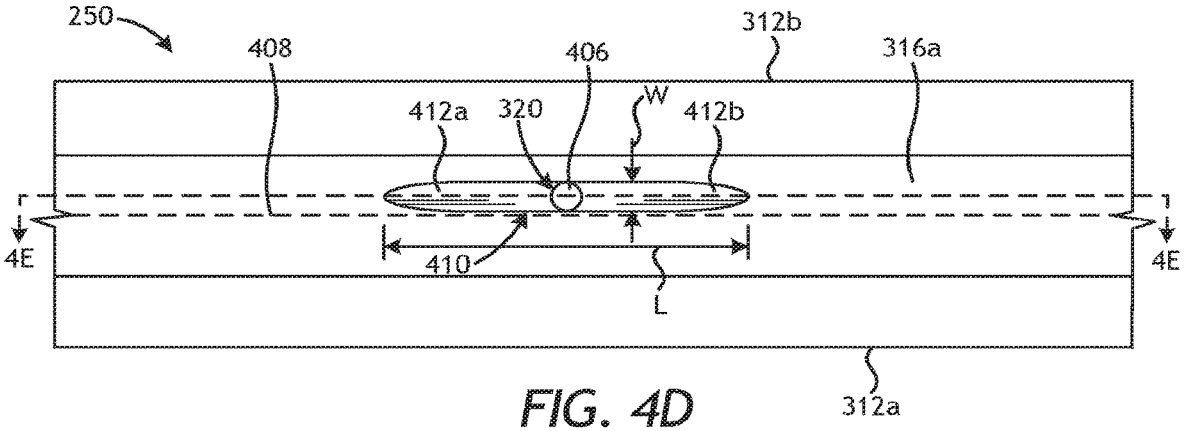

FIG. 4D is an enlarged view of a portion of the dynamic surface 316*a*. In some embodiments, the outlet aperture 406 defined in the dynamic surface 316*a* may be offset from an annular centerline 408 of the sealing element 250. The annular centerline 408 is the axial midpoint of the contact area of the sealing element 250 between the first and second axial surfaces 312*a,b*. In the illustrated embodiment, the outlet aperture 406 is defined in the dynamic surface 316*a* at a location that is axially offset from the annular centerline 408 and axially closer to the second axial surface 312*b*. In other embodiments, however, the outlet aperture 406 may be defined in the dynamic surface 316*a* at a location that is axially offset from the annular centerline 408 and axially closer to the first axial surface 312*a*, or aligned with the annular centerline 408, without departing from the scope of the disclosure.

Having the outlet aperture 406 located axially closer to the second axial surface 312*b*, as compared to being closer to the first axial surface 312*a*, may prove advantageous in prolonging the operational lifespan of the sealing element 250. More specifically, a slurry of abrasive particulates commonly forms at the first axial surface 312*a* during operation, and will progressively erode away at the annular body 400 (FIGS. 4A-4B) on the first axial surface 312*a* as the sealing element 250 rotates (or as an opposing surface/substrate rotates). Eventually the axial thickness of the annular body 400 will erode away enough to reach the outlet aperture 406, which could adversely affect the sealing performance of the sealing element 250. Placing the outlet aperture 406 closer to the second axial surface 312*b*, however, provides the sealing element 250 with a longer operational lifespan until the erosion reaches the outlet aperture 406. Assuming the distance between the first and second axial surfaces 312*a,b* can be characterized as a percentage of axial distance between the two, the first axial surface 312*a* may be located at 100% of the axial distance and the second axial surface 312*b* may be located at 0%. In such a measurement scenario, the outlet aperture 406 may be located at a distance between about 49% and 10% of the axial distance between the first and second axial surfaces 312*a,b*.

In some embodiments, each lubricant channel 320 may also include a slot 410 defined in the dynamic surface 316*a* and contiguous with the outlet aperture 406. Each slot 410 may generally comprise a recess formed on the dynamic surface 316*a* that connects the outlet aperture 406 to the dynamic surface 316*a*. The slot 410 may exhibit a length L and a width W, where the length L extends generally along the arcuate length of the dynamic surface 316*a* and the width W extends generally in the axial direction between the opposing first and second axial surfaces 312*a,b*. The length L is typically greater than the width W, but in alternative embodiments, the width W may be greater than the length L, without departing from the scope of the disclosure.

In some embodiments, as illustrated, the slot 410 may include a first furrow 412*a* extending from the outlet aperture 406 in a first direction and a second furrow 412*b* extending from the outlet aperture 406 in a second direction opposite the first direction. In other embodiments, however, only one furrow 412*a,b* may be included.

Figure 4E:
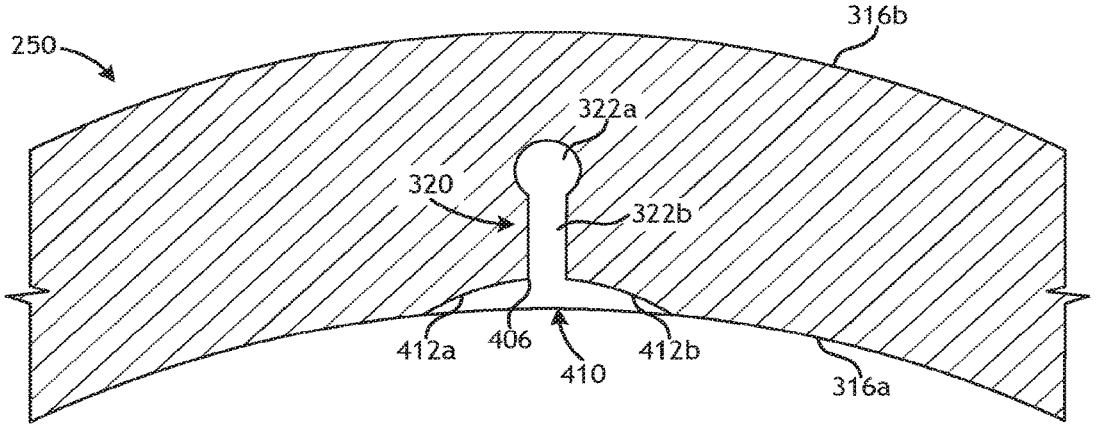

FIG. 4E is a cross-sectional side view of the sealing element 250 as taken along the lines 4E-4E in FIG. 4D. The depth of each furrow 412*a,b* may vary as extending from the outlet aperture 406 in each direction and otherwise along the arcuate length of the dynamic surface 316*a*. In the illustrated embodiment, for example, each furrow 412*a,b* tapers radially inward and toward the dynamic surface 316*a* as extending in each corresponding direction away from the outlet aperture 406. Consequently, the depth of the furrows 412*a,b* may be deepest near the outlet aperture 406 and tapers to zero or flush with the dynamic surface 316*a* at the ends of the length L (FIG. 4D). The furrows 412*a,b* may taper at an angle or alternatively over a curved or arcuate surface. In some embodiments, the taper of the furrows 412*a,b* may undulate.

The slots 410 may prove advantageous for inducing hydroplaning during operation of the sealing element 250. More particularly, the lubricant 310 (FIGS. 2B and 3) exits the outlet aperture 406 and is fed into the furrows 412*a,b* during operation. The lubricant 310 is continuously expressed (discharged) onto the opposing stationary or dynamic surface (e.g., the first journal surface 302*a* of FIG. 3) and a high local pressure is achieved that overcomes the seal contact pressure at the dynamic interface. This allows the lubricant 310 to migrate into the dynamic interface and thereby separate the dynamic surface 316*a* from the opposing surface. This also helps spread the lubrication 310 over a larger surface area on the dynamic surface 316*a*. This continuous leak (discharge) of lubricant 310 helps maintain constant lubrication at the dynamic interface and also cleans contamination off the dynamic surface.

Figure 5A:
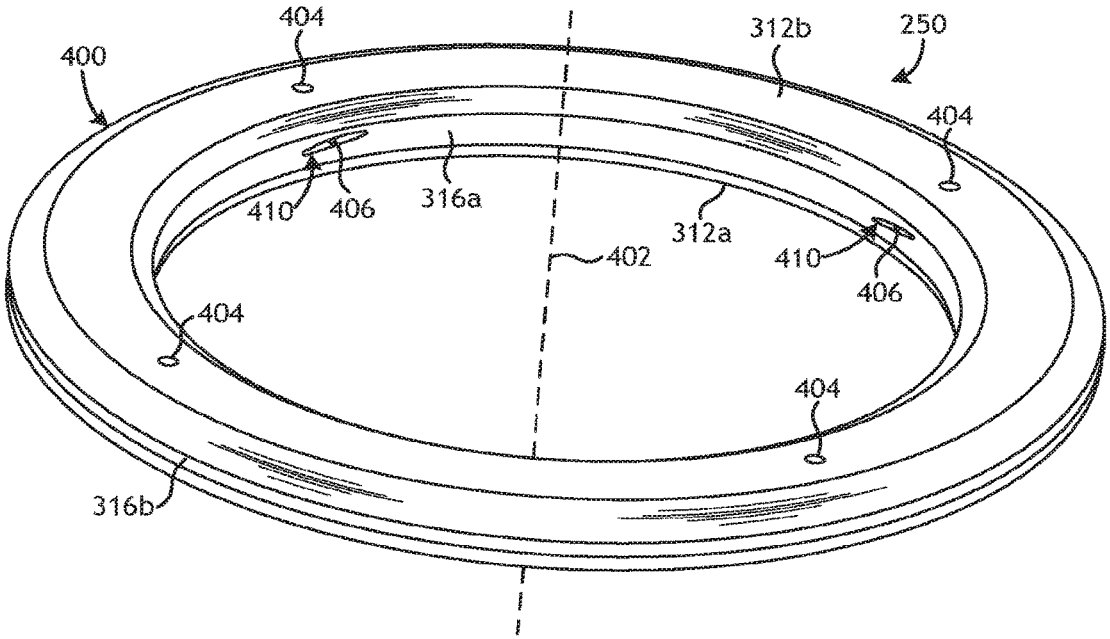
FIGS. 5A and 5B are views of another embodiment of the sealing element of FIGS. 2B and 3, according to one or more embodiments.

FIG. 5A is an isometric view of another embodiment of the sealing element 250 of FIGS. 2B and 3, according to one or more embodiments. Similar to the sealing element 250 of FIGS. 4A-4E, the sealing element 250 of FIG. 5A includes the annular body 400 that defines one or more inlet apertures 404 (four shown) in the second axial surface 312*b* and one or more outlet apertures 406 (two shown in FIG. 5A) in the dynamic surface 316*a*. Moreover, the sealing element 250 of FIG. 5A may also include one or more slots 410 defined in the dynamic surface 316*a* and contiguous with each outlet aperture 406. Unlike the sealing element 250 of FIGS. 4A-4E, however, the slots 410 of the sealing element 250 of FIG. 5A are defined in the dynamic surface 316*a* at an angle with respect to the annular centerline 408 of the sealing element 250 or alternatively at an angle offset from perpendicular to the central axial 402.

Figure 5B:
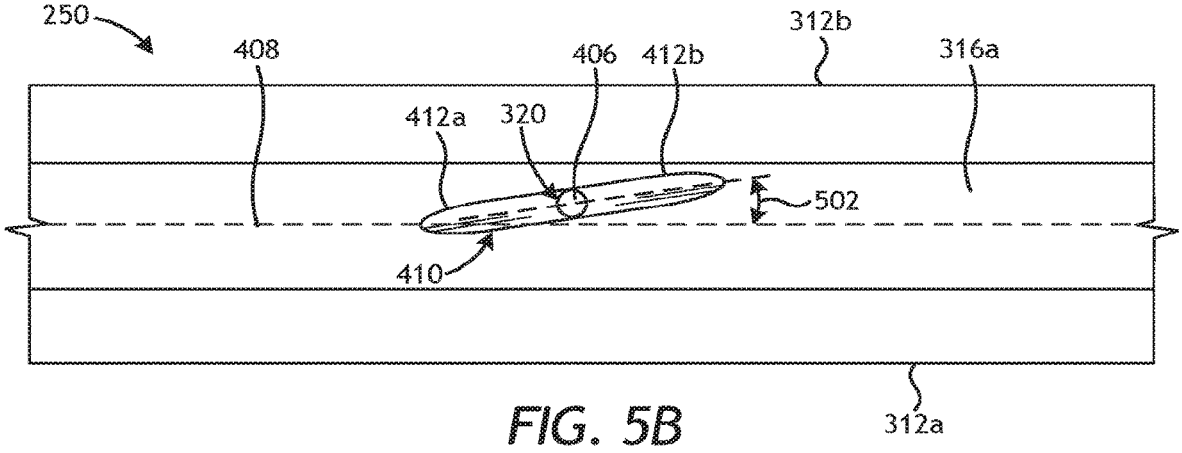

FIG. 5B is an enlarged view of a portion of the dynamic surface 316*a*. As shown in FIG. 5B, the first and second furrows 412*a,b* extend from the outlet aperture 406 in opposing directions and at an angle 502 with respect to the annular centerline 408. The angle 502 may range from 1° to 90° relative to the annular centerline 408. As will be appreciated, increasing the magnitude of the angle 502 may prove advantageous in increasing the surface area on the opposing surface being swept by the furrows 412*a,b*. Furthermore, with rotation of the sealing element 250 relative to the journal 222 (FIG. 2B), the angle 502 adds axial pumping and helps push the lubricant 310 (FIG. 3) toward the first axial surface 312*a*. more specifically, when the dynamic surface 316*a* moves (as in rotation) from left to right in FIG. 5B, the slot 410 arranged at the angle 502 may help to push or urge the lubricant 310 toward the first axial surface 312*a* as compared to a slot that is parallel to the annular centerline 408.

Figure 6:
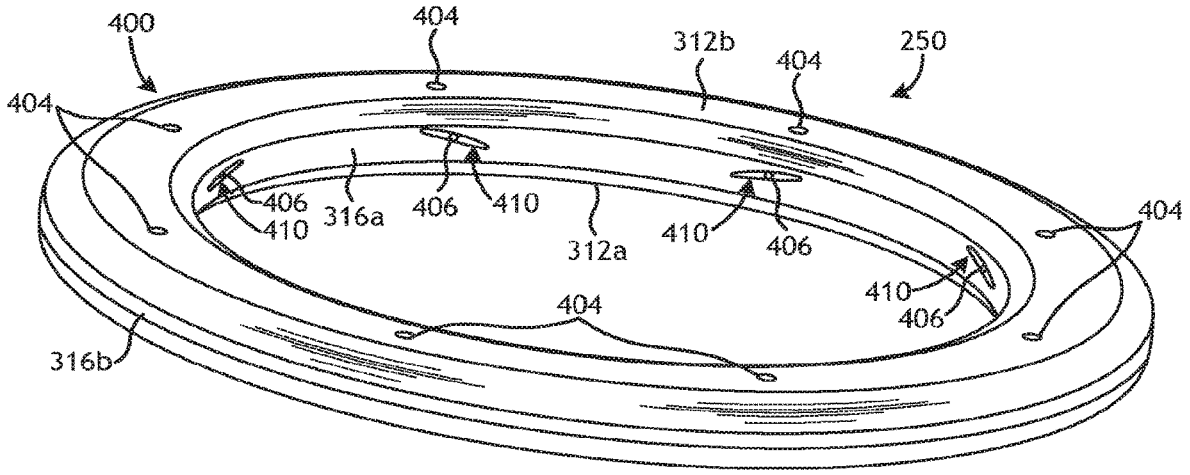
FIG. 6 is an isometric view of another embodiment of the sealing element of FIGS. 2B and 3.

FIG. 6 is an isometric view of another embodiment of the sealing element 250 of FIGS. 2B and 3, according to one or more embodiments. Similar to prior embodiments of the sealing element 250, the sealing element 250 of FIG. 6 includes the annular body 400 that defines one or more inlet apertures 404 (eight shown) in the second axial surface 312*b* and one or more outlet apertures 406 (four shown) in the dynamic surface 316*a*. Moreover, the sealing element 250 of FIG. 6 may also include a plurality of slots 410 defined in the dynamic surface 316*a* and contiguous with each associated outlet aperture 406.

Unlike the sealing element 250 of prior embodiments, however, the slots 410 of the sealing element 250 of FIG. 6 are defined in the dynamic surface 316*a* at varying angles with respect to the annular centerline 408 (FIGS. 4D and 5B) of the sealing element 250. More specifically, angularly adjacent slots 410 defined in the dynamic surface 316*a* may exhibit alternating angles with respect to the annular centerline 408. In other embodiments, the angles of angularly adjacent slots 410 may not necessarily alternate, but they may be different nonetheless, without departing from the scope of the disclosure. The slots 410 configured at alternating angles may help maintain good lubrication of the underlying sealing areas on both angular sides of the outlet apertures 406.

FIGS. 7A-7J are cross-sectional end views of example designs for various sealing elements 700*a*-700*f* that may be used in accordance with the present disclosure. Each sealing element 700*a*-700*f* may be similar to the sealing element 250 of FIG. 3 and therefore may be best understood with reference thereto, where like numerals represent like elements or components not described again. For instance, each sealing element 700*a-f* may provide the opposing first and second axial surfaces 312*a,b*, the dynamic surface 316*a*, and the outer radial surface 316*b*. Each sealing element 700*a-f* may also provide a channel 320 extending between the second axial surface 312*b* and the dynamic surface 316*a* to convey the lubricant 310 (FIG. 3) from the lubricant chamber 318 (FIG. 3) directly to the interface between the dynamic surface 316*a* and an opposing surface (e.g., the first journal surface 302*a* of FIG. 3). Each lubricant channel 320 may further include the inlet and outlet apertures 404, 406, as generally described above.

Figure 7A:
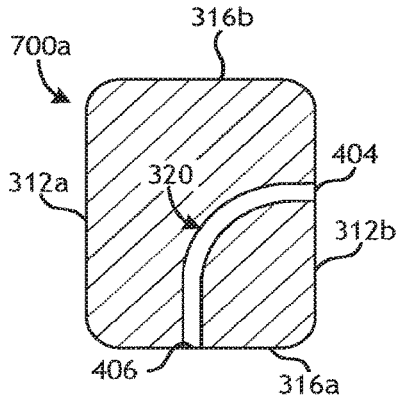
FIGS. 7A-7J are cross-sectional end views of example sealing elements that may be used in accordance with the present disclosure.
Figure 7B:
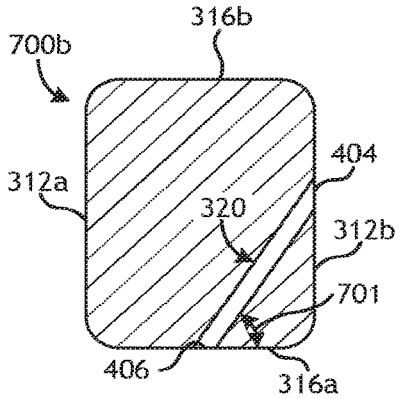

In FIG. 7A, the lubricant channel 320 is defined as a curved or arcuate conduit extending between the second axial surface 312*b* and the dynamic surface 316*a*. In at least one embodiment, as illustrated, portions of the lubricant channel 320 may be straight as well as curved. In FIG. 7B, the lubricant channel 320 is defined as a straight conduit or passageway extending between the second axial surface 312*b* and the dynamic surface 316*a* at an angle 701 relative to one or both of the second axial surface 312*b* and the dynamic surface 316*a*. The angle 701 of the lubricant channel 320 may vary, depending on the application, but will nonetheless extend between the second axial surface 312*b* and the dynamic surface 316*a*.

Figure 7C:
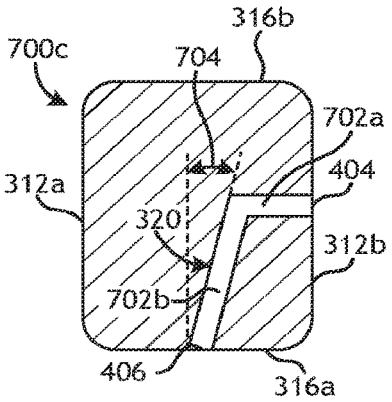

In FIG. 7C, the lubricant channel 320 provides an axial channel 702*a* extending from the second axial surface 312*b* and a radial channel 702*b* extending from the dynamic surface 316*a* and intersecting at a location within the interior of the sealing element 700*c*. As illustrated, the axial channel 702*a* extends from the second axial surface 312*b* substantially parallel to the dynamic surface 316*a*. The radial channel 702*b* may extend at an angle 704 offset from perpendicular to the dynamic surface 316*a*. In alternative embodiments, the axial channel 702*a* may instead extend from the dynamic surface 316*a* at an angle offset from parallel to the dynamic surface 316*a* while the radial channel 702*b* may extend perpendicular to the dynamic surface 316*a*. In yet other embodiments, both the axial and radial channels 702*a,b* may extend at corresponding angles offset from parallel and perpendicular, respectively, to the dynamic surface 316*a*, without departing from the scope of the disclosure.

Figure 7D:
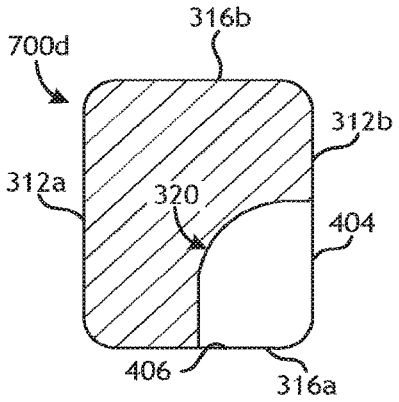

In FIG. 7D, the lubricant channel 320 is formed in the sealing element 700*d* by removing contiguous sections of the second axial surface 312*b* and the dynamic surface 316*a* such that a corner section of the sealing element 700*d* is excised. In this embodiment, the inlet and outlet apertures 404, 406 form a contiguous passageway.

Figure 7E:
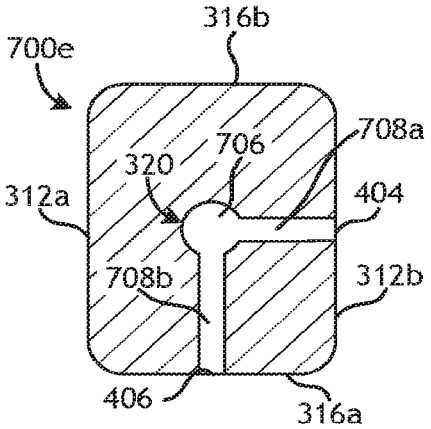
Figure 7F:
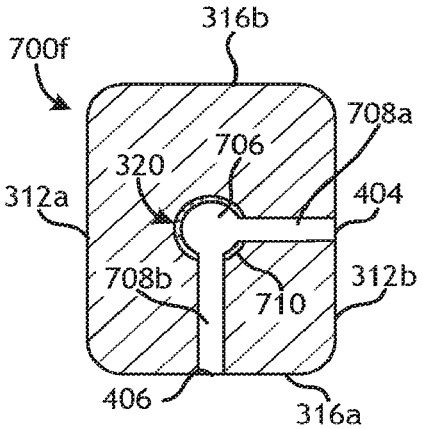

In FIGS. 7E and 7F, the lubricant channel 320 includes an annular conduit 706 that fluidly communicates an axial channel 708*a* extending from the second axial surface 312*b* with a radial channel 708*b* extending from the dynamic surface 316*a*. Accordingly, the axial and radial channels 708*a,b* intersect and otherwise fluidly communicate at the annular conduit 706. The annular conduit 706 comprises an annular passageway defined within and otherwise extending through the entire annular body of the sealing elements 700*e,f*. The annular conduit 706 of FIG. 7E may be molded into the sealing element 700*e* during the manufacturing process. The annular conduit 706 of FIG. 7F, however, may comprise a tube or pipe 710 and the sealing element 700*f* may be molded around the pipe 710.

In some embodiments, the axial and radial channels 708*a,b* may be molded into the sealing elements 700*e,f* during the manufacturing process. In other embodiments, however, the axial and radial channels 708*a,b* may be machined (e.g., drilled) into the sealing elements 700*e,g* and thereby locate and tap into the annular conduit 706 at their respective locations.

In operation, the lubricant 310 (FIG. 3) enters the lubricant channel 320 at the inlet aperture 404 and flows to the annular conduit 706 via the axial channel 708*a*. The lubricant 310 may then fill the annular conduit 706 and distribute the lubricant to the radial channel 708*b* to be discharged via the outlet aperture 406. The sealing elements 700*e,f* may generate a pumping action as the sealing element 700*e,f* is rotated from the loaded to the unloaded side of the bearing, similar to operation of a peristaltic pump. Accordingly, in some embodiments, the sealing elements 700*e,f* may require only one inlet aperture 404 and an associated axial channel 708*a* that feeds the lubricant 310 to the annular conduit 706. In such embodiments, the sealing elements 700*e,f* may include one or multiple radial channels 708*b* and associated outlet apertures 406 to dispense the lubricant 310 from the annular conduit 706 at the dynamic interface.

Figure 7G:
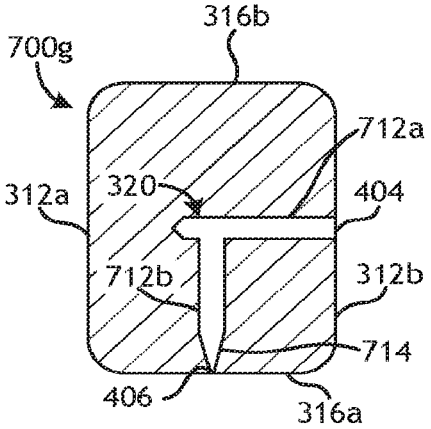
Figure 7H:
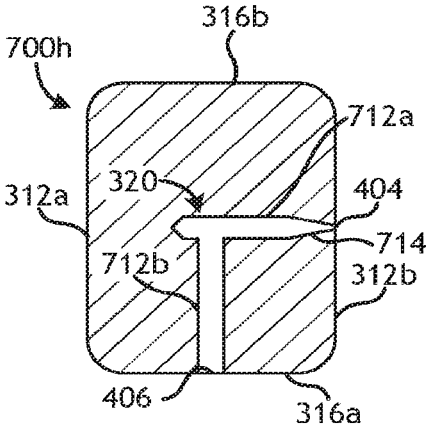

In FIGS. 7G and 7H, the lubricant channel 320 comprises an axial channel 712*a* extending from the second axial surface 312*b* with a radial channel 712*b* extending from the dynamic surface 316*a*. The axial and radial channels 712*a,b* intersect and otherwise fluidly communicate at a point in the interior of the sealing element 700*g* and 700*h*. In the illustrated embodiment, the walls of the lubricant channel 320 are not necessarily parallel at all locations. Rather, as illustrated, at least a portion of the walls of the radial channel 712*b* may vary, such as at a tapered section 714. In FIG. 7G, the tapered section 714 is located at or near the outlet aperture 406, and in FIG. 7H, the tapered section 714 is located at or near the inlet aperture 404. In other embodiments, the lubricant channel 320 may include the tapered section 714 at both the inlet and outlet apertures 404, 406.

The tapered section 714 may be large enough for the lubricant channel 320 to remain open when the sealing element 700*g* is compressed, or the lubricant channel 320 may alternatively close upon being compressed. When the lubricant channel 320 is compressed to close the inlet or outlet apertures 404, 406, the lubricant channel 320 may act as a lubricant reservoir initially, but as the sealing element 700*g* wears, the inlet or outlet apertures 404, 406 will gradually open and thereby allow communication between the second axial surface 312*b* and the dynamic surface 316*a* to decrease friction in the worn state. Accordingly, the sealing elements 700*g* and 700*h* may operate as a type of valve that may be opened after an amount of wear has occurred, and enough wear to open the inlet or outlet apertures 404, 406 to facilitate discharge of the lubricant 310 (FIG. 3).

In embodiments where the sealing elements 700*g,h* exhibits an oval or elliptical cross-section, the wear on the sealing element 700*g,h* may allow operation as a valve. More specifically, an oval sealing element 700*g,h* may be aligned such that when it is under compression the tapered section 714 opens or when the compression is perpendicular the tapered section 714 closes. These orientations would allow the oval sealing element 700*g,h* acting as a valve to open or close as the sealing element 700*g,h* wears and compression is gradually relieved.

Figure 7I:
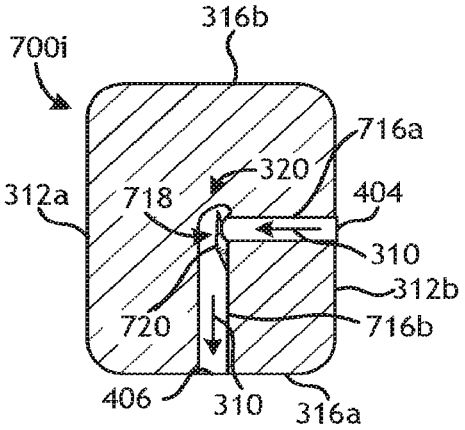
Figure 7J:
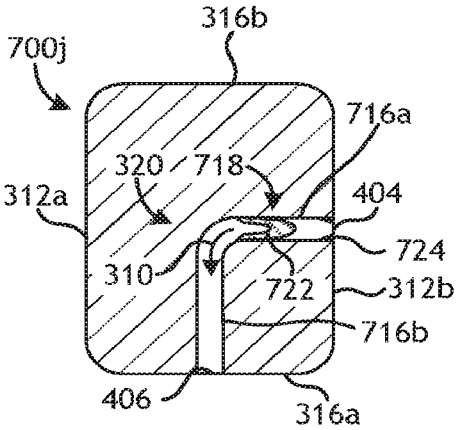

In FIGS. 7I and 7J, the lubricant channel 320 comprises an axial channel 716*a* extending from the second axial surface 312*b* with a radial channel 716*b* extending from the dynamic surface 316*a*. The axial and radial channels 716*a,b* intersect and otherwise fluidly communicate at a point in the interior of the sealing elements 700*i* and 700*j*. The sealing elements 700*i,j* may further each include a valve member 718 positioned within the lubricant channel 320.

In FIG. 7I, the valve member 718 may comprise a flap 720 coupled to the wall of at least one of the axial and radial channels 716*a,b*. In the illustrated embodiment, the flap 720 is depicted as being coupled to and otherwise extending from the radial channel 716*b*. The flap 720 may be flexible and operate as a one-way valve that allows the lubricant 310 to flow from the inlet aperture 404 to the outlet aperture 406, but prevent the lubricant 310 from flowing in the reverse direction.

In FIG. 7J, the valve member 718 may comprise a funnel 722 positioned within at least one of the axial and radial channels 716*a,b*. In the illustrated embodiment, the funnel 722 is depicted as being positioned within the axial channel 716*a*. The funnel 722 may also operate as a one-way valve that allows the lubricant 310 to flow from the inlet aperture 404 to the outlet aperture 406, but prevent the lubricant 310 from flowing in the reverse direction. The sealing element 700*j*, however, may further include a choke 724 arranged at the inlet aperture 404. The choke 720 may be characterized as a reduced diameter section of the axial channel 716*a*. In embodiments where the sealing element 700*j* rotates, the choke 724 may be designed to open at an unloaded side and close at a loaded side, which may cause a pumping action to the flow of the lubricant. At the unloaded side, the choke 724 may open and draw in the lubricant 310 and, as the sealing element 700*j* rotates to the loaded side, the choke 724 may be configured to close as the sealing element 700*j* is compressed, which results in the lubricant 310 being squeezed or discharged out the outlet aperture 406.

Figure 8A:
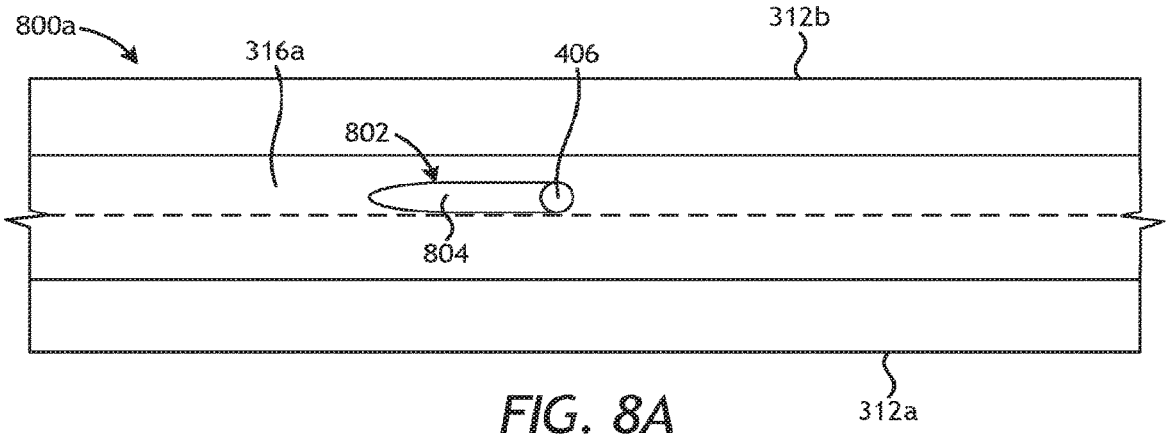
FIGS. 8A and 8B are enlarged views of a portion of the dynamic surface of additional example sealing elements.
Figure 8B:
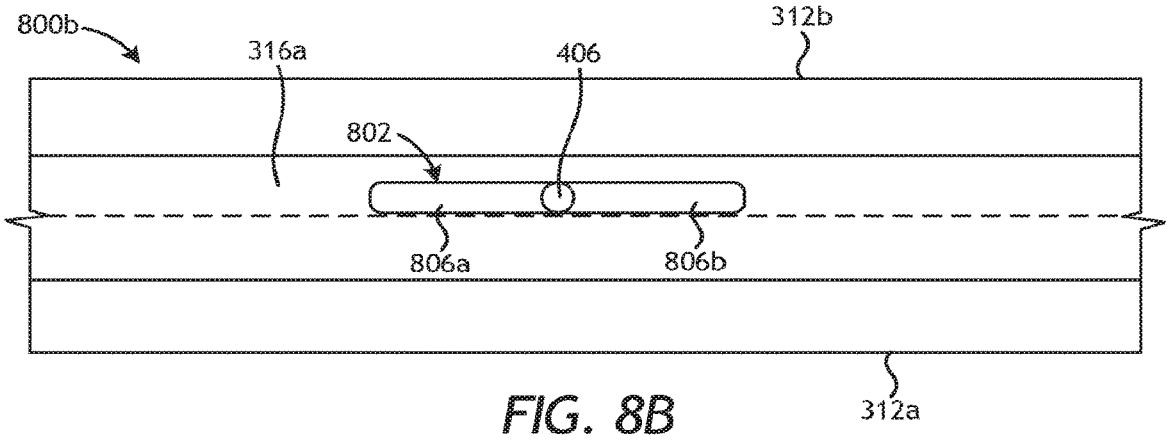

FIGS. 8A and 8B are enlarged views of a portion of the dynamic surface 316*a* of additional example sealing elements 800*a* and 800*b*, according to one or more embodiments. Each sealing element 800*a,b* may be similar to the sealing element 250 of FIGS. 3 and 4A-4F and therefore may be best understood with reference thereto, where like numerals represent like elements or components not described again. Each sealing element 800*a,b* may provide the opposing first and second axial surfaces 312*a,b* and the dynamic surface 316*a*. Moreover, each sealing element 800*a,b* may also provide at least one slot 802 defined in the dynamic surface 316*a* and contiguous with an associated outlet aperture 406. Similar to the slots 410 described above with reference to FIGS. 4A-4F, each slot 802 generally comprise a recess formed on the dynamic surface 316*a* that connects the outlet aperture 406 to the dynamic surface 316*a*.

In FIG. 8A, the slot 802 includes a single furrow 804 extending from the outlet aperture 406 in a first direction along the arcuate length of the dynamic surface 316*a*. In other embodiments, the furrow 804 may extend from the outlet aperture 406 in a second direction opposite the first direction, without departing from the scope of the disclosure. The design and description of the furrow 804 may be similar to the first or second furrows 412*a,b* of FIGS. 4C-4E and, therefore, will not be described again in detail.

In FIG. 8B, the slot 802 may include a first furrow 806*a* extending from the outlet aperture 406 in a first direction and a second furrow 806*b* extending from the outlet aperture 406 in a second direction opposite the first direction and along the arcuate length of the dynamic surface 316*a*. Similar to the slots 410 of FIGS. 4A-4E, the depth of each furrow 806*a,b* may vary extending from the outlet aperture 406 in each direction and otherwise along the arcuate length of the dynamic surface 316*a*. Unlike the first and second furrows 412*a,b* of FIGS. 4C-4E, however, which each exhibit a generally teardrop shape, the first and second furrows 806*a,b* may each exhibit a generally polygonal shape with rounded corners or edges. Those skilled in the art will appreciate that other shapes may be employed for the furrows 806*a,b*, without departing from the scope of the disclosure. Moreover, in some embodiments, the first and second furrows 806*a,b* may exhibit different shapes.

Figure 9A:
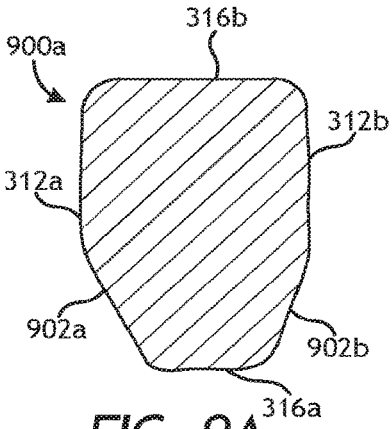
FIGS. 9A-9C are cross-sectional end views of additional example sealing elements that may be used in accordance with the present disclosure.
Figure 9B:
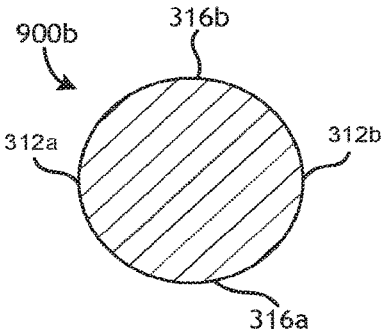
Figure 9C:
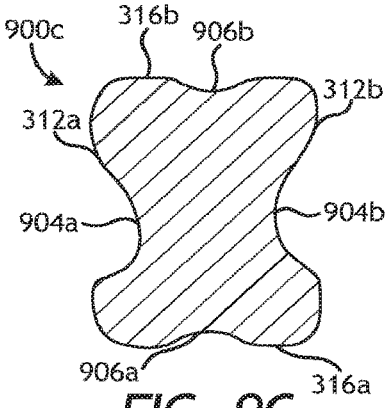

FIGS. 9A-9C are cross-sectional end views of example sealing elements 900*a*, 900*b*, and 900*c*, respectively, that may be used according to the principles of the present disclosure. Each sealing element 900*a-c* may be similar to the sealing element 250 of FIG. 3 and therefore may be best understood with reference thereto, where like numerals represent like elements or components not described again. For instance, each sealing element 900*a-c* may provide the opposing first and second axial surfaces 312*a,b*, the dynamic surface 316*a*, and the outer radial surface 316*b*. Whereas the sealing elements shown in any of the prior figures each exhibit a generally polygonal cross-sectional end shape with rounded corner or edges (see, for example, FIGS. 7A-7F), the sealing elements 900*a-c* of FIG. 9A-9C may exhibit different cross-sectional end shapes.

In FIG. 9A, for example, the cross-sectional end shape of the sealing element 900*a* may be generally polygonal (i.e., rectangular) with angled portions 902*a* and 902*b* excised from one or both of the first and second axial surfaces 312*a,b*. This reduces the contact area of the dynamic surface 316*a* while providing stability and compliance.

In FIG. 9B, the cross-sectional end shape of the sealing element 900*b* may be generally circular or ovoid (i.e., oval). Accordingly, in such embodiments, the sealing element 900*b* may be characterized as an O-ring or the like. The sealing element 900*b* may prove advantageous in being in the form of general industry standard, which is simple to make and, therefore, less expensive.

In FIG. 9C, the cross-sectional end shape of the sealing element 900*c* may be generally polygonal (i.e., rectangular), but portions of one or more of the first and second axial surfaces 312*a,b*, the dynamic surface 316*a*, and the outer surface 316*b* may be removed. As illustrated, for example, the one or both of the first and second axial surfaces 312*a,b* may define side grooves 904*a* and 904*b*. The side grooves 904*a,b* may be arcuate (i.e., rounded) or include sharp angled surfaces (i.e., polygonal). In some embodiments, the side grooves 904*a,b* may be defined on the first and second axial surfaces 312*a,b* along the entire circumference of the sealing element 900*c*. In other embodiments, however, the side grooves 904*a,b* may be defined on the first and second axial surfaces 312*a,b* along only a portion of the circumference of the sealing element 900*c*.

In some embodiments, as illustrated, one or both of the dynamic surface 316*a* and the outer radial surface 316*b* may also include a groove 906*a* and 906*b*. Similar to the side grooves 904*a,b*, the grooves 906*a,b* may be arcuate (i.e., rounded) or may alternatively include sharp angled surfaces (i.e., polygonal). The groove 906*a* defined on the dynamic surface, in particular, may exhibit various shapes including, but not limited to, a v-channel, a concave shape, a convex shape, and any combination thereof. In some embodiments, the grooves 906*a,b* may be defined on the dynamic surface 316*a* and the outer radial surface 316*b*, respectively, along the entire inner and outer radial surfaces of the sealing element 900*c*. In other embodiments, however, the grooves 906*a,b* may be defined on the dynamic surface 316*a* and the outer radial surface 316*b*, respectively, along only a portion of the inner and outer radial surfaces of the sealing element 900*c*. As will be appreciated, the side grooves 904*a,b* and the grooves 906*a,b* may prove advantageous in reducing the contact area and reducing contact pressure as well as friction of the dynamic surface 316*a* while providing compliance with multiple defined boundaries separating the mud and the lubricant.

In some embodiments, the dynamic surface 316*a* may further include or otherwise define one or more surface features. Example surface features that may be included on the dynamic surface 916*a* include, but are not limited to, texture, dimples, undulations, cross-hatching, waves, and any combination thereof. Those skilled in the art will readily recognize that such surface features may minimize surface contact at the dynamic interface, which minimizes friction.

Figure 10:
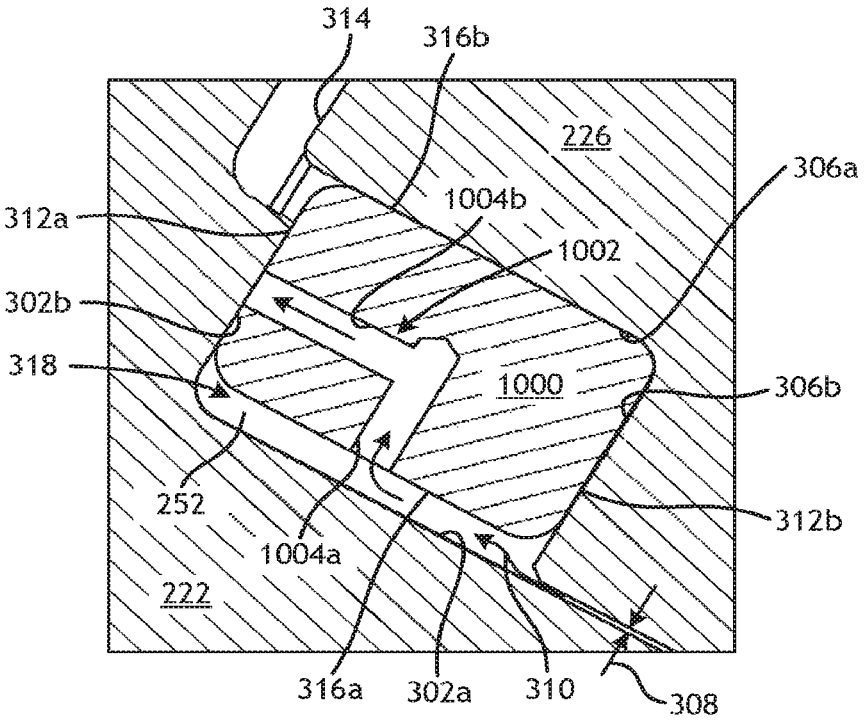
FIG. 10 is an enlarged cross-sectional side view of a portion of the drill bit of FIG. 2B showing another example embodiment of a sealing element.

FIG. 10 is an enlarged cross-sectional side view of a portion of the drill bit 200 of FIG. 2B showing another example embodiment of a sealing element 250, referenced in FIG. 10 at 1000, and as received within the seal groove 252. As generally described above, the lubricant 310 is pumped into the gap 308 to lubricate the interface between the journal 222 and the roller cone 226, and subsequently enter the seal groove 252 to provide lubrication for the dynamic sealing engagement provided by the sealing element 1000.

The sealing element 1000 may be similar in some respects to the sealing element 250 described above and therefore may be best understood with reference thereto, where like numerals will correspond to like components or elements. For instance, the sealing element 1000 may be made of the same materials as the sealing element 250. Moreover, as illustrated, the sealing element 1000 includes the first and second axial surfaces 312*a,b* and the opposing inner and outer radial surfaces 316*a,b*.

Unlike the sealing element 250 of FIG. 3, however, the sealing element 1000 of FIG. 10 is configured as an axial seal where the first and second axial surfaces 312*a,b* provide sealed interfaces against opposing surfaces of the seal groove 252 during operation. More specifically, the first axial surface 312*a* is configured to sealingly engage the second journal surface 302*b*, while the second axial surface 312*b* is configured to sealingly engage the second cone surface 306*b*. The sealing element 1000 is maintained under sufficient axial compression to ensure maintenance of a seal at the interface between the first axial surface 312*a* and the second journal surface 302*b* and the interface between the second axial surface and the second cone surface 306*b*.

The sealing element 1000 may be configured to rotate with rotation of the roller cone 226 or may alternatively remain stationary with the journal 222. In embodiments where the sealing element 1000 rotates with the roller cone 226 relative to the journal 222, the first axial surface 312*a* will be characterized as a "dynamic surface." In contrast, in embodiments where the sealing element 1000 remains stationary with the journal 222 relative to the roller cone 226, the second axial surface 312*b* will be characterized as the "dynamic surface." For purposes of the present description, however, it will be assumed that the sealing element 1000 rotates with the roller cone 226 relative to the journal 222 and, therefore, the first axial surface 312*a* will be referred to herein as the "dynamic surface 312*a*." It will be appreciated, however, that the principles of the present disclosure are equally applicable to embodiments where the second axial surface 312*b* serves as the dynamic surface, without departing from the scope of the disclosure.

In some embodiments, as illustrated, the inner radial surface 316*a* is spaced from the first journal surface 302*a* and thereby defines the lubricant chamber 318 within the seal groove 252. During operation, the lubricant 310 is pumped or otherwise conveyed into the lubricant chamber 318. Accordingly, the inner radial surface 316*a* will be exposed to the lubricant 310 entering the seal groove 252 via the gap 308 and, therefore, may be referred to and otherwise characterized as a "lubricant surface."

The sealing element 1000 may provide a lubricant channel 1002 that extends between the inner radial surface 316*a* and the dynamic surface 312*a*. The lubricant channel 1002 may be machined into the sealing element 1000 or may alternatively be molded into the sealing element 1000 during manufacture. The lubricant channel 1002 provides a fluid passageway or conduit configured to convey the lubricant 310 from the lubricant chamber 318 directly to the dynamic surface 312*a* (i.e., the interface between the dynamic surface 312*a* and the second journal surface 302*b*) and at a radial location between the inner and outer radial surfaces 316*a,b*.

In the illustrated embodiment, a radial channel 1004*a* and an axial channel 1004*b* jointly define the lubricant channel 1002. The radial channel 1004*a* extends from the inner radial surface 316*a* and the axial channel 1004*b* extends from the dynamic surface 312*a* and is substantially perpendicular to the radial channel 1004*a*. The radial and axial channels 1004*a,b* intersect at a location within the interior of the sealing element 1000 to facilitate fluid communication from the lubricant chamber 318 to the dynamic surface 312*a*.

Similar to the sealing element 250 of FIG. 3, several variations and designs of the sealing element 1000 and the lubricant channel 1002 may be employed without departing from the scope of the disclosure. The following figures and discussion provide various contemplated designs and configurations for the sealing element 1000 and the lubricant channel 1002, but should not be considered as limiting the scope of the disclosure. Rather, those skilled in the art will readily recognize that other designs and configurations could equally be used in keeping with the principles described herein.

Figure 11A:
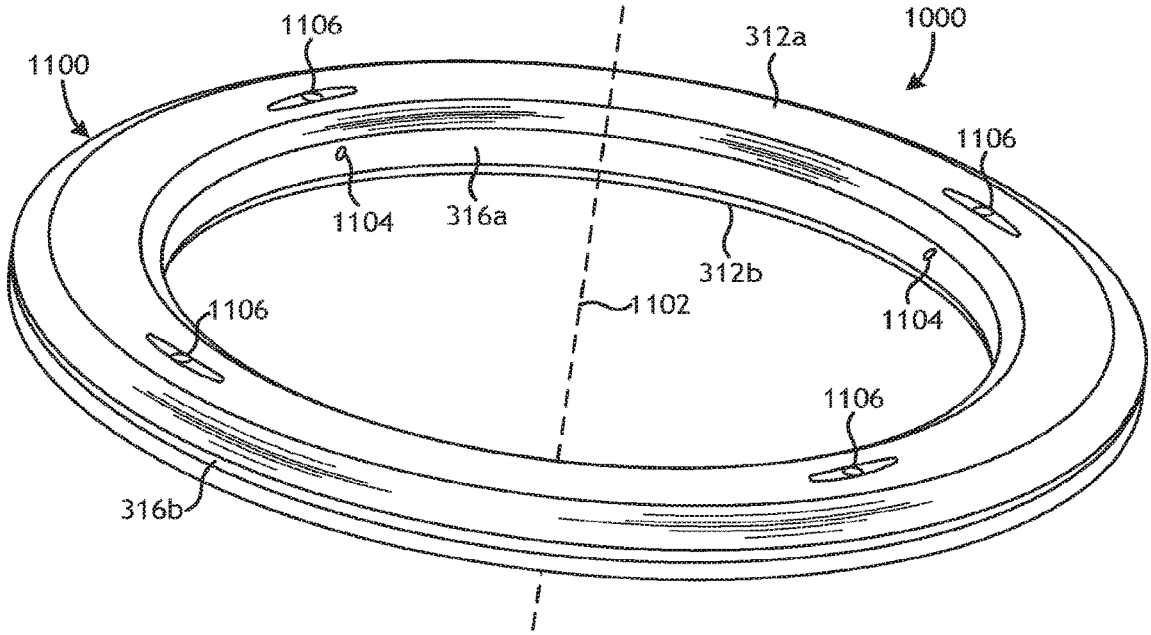
FIGS. 11A-11E are various views of the sealing element of FIG. 10.

FIGS. 11A-11E are various views of the sealing element 1000 of FIG. 10, according to one or more embodiments. As illustrated in FIG. 11A, the sealing element 1000 comprises an annular body 1100 that provides the opposing inner and outer radial surfaces 316*a,b*, the dynamic surface 312*a*, and the second axial surface 312*b*. The annular body 1100 also provides a central axis 1102. One or more inlet apertures 1104 (two shown in FIG. 11A) may be defined in the inner radial surface 316*a* and one or more outlet apertures 1106 (four shown in FIG. 11A) may be defined in the dynamic surface 312*a* (i.e., the first axial surface).

Figure 11B:
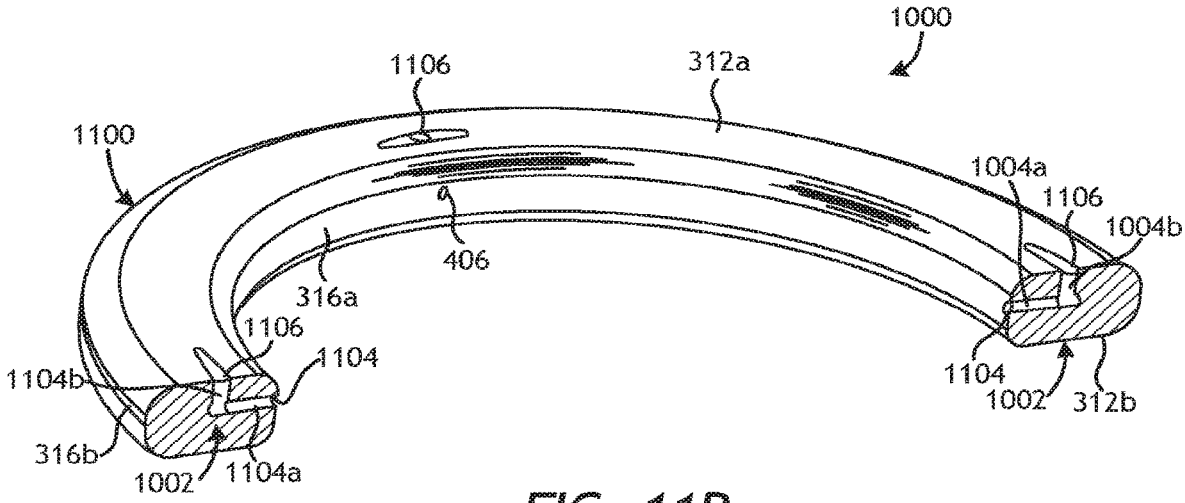
Figure 11C:
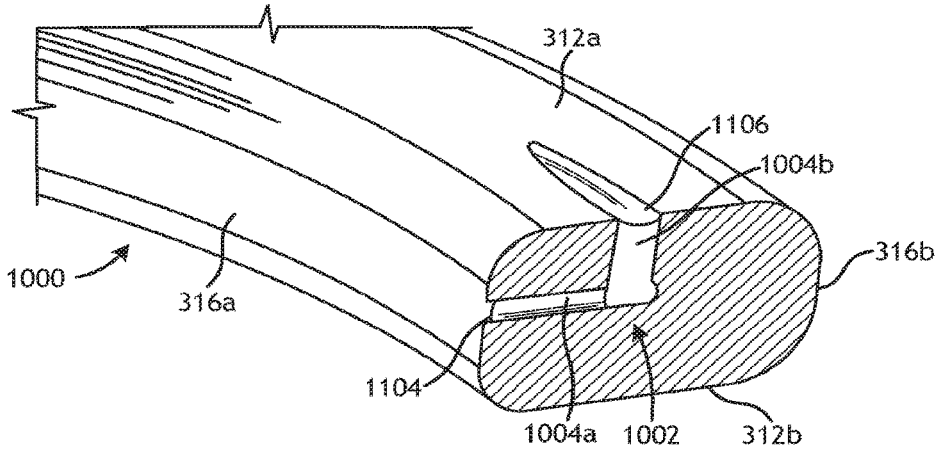

FIG. 11B is a partial cross-sectional view of the sealing element 1000 as taken through angularly opposite channels 1002, and FIG. 11C is an enlarged cross-sectional view of the sealing element 1000 as taken through one of the channels 1002. Each inlet and outlet aperture 1104, 1106 provides access into a corresponding channel 1002 extending between the inner radial surface 316*a* and the dynamic surface 312*a*. Each lubricant channel 1002 includes the radial channel 1004*a* extending from the inner radial surface 316*a* and the axial channel 1004*b* extending from the dynamic surface 312*a* and intersecting at a location within the interior of the sealing element 1000 to facilitate fluid communication from the lubricant chamber 318 (FIG. 10) to the dynamic surface 312*a*. In some embodiments, the axial channel 1004*b* may extend from the dynamic surface 312*a* substantially parallel to the central axis 1102 (FIG. 11A), and the radial channel 1004*b* may extend substantially perpendicular to both the radial channel 1004*a* and the central axis 1102. It will be appreciated, however, that the radial and axial channels 1004*a,b* may alternatively extend at various other angles and nonetheless provide fluid communication between the inner radial surface 316*a* and the dynamic surface 312*a*, without departing from the scope of the disclosure.

Figure 11D:
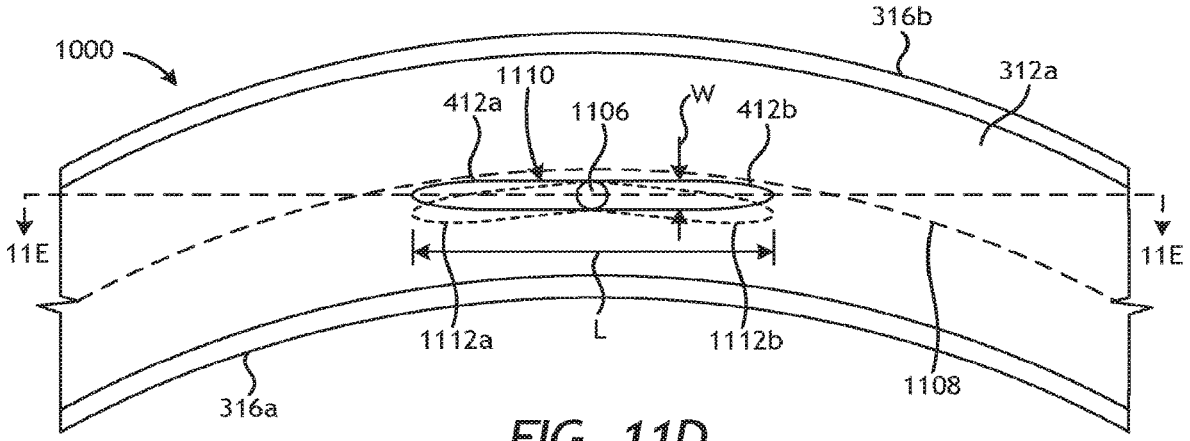

FIG. 11D is an enlarged view of a portion of the dynamic surface 312*a*. In some embodiments, the outlet aperture 1106 defined in the dynamic surface 312*a* may be offset from an annular centerline 1108 of the sealing element 1000. The annular centerline 1108 is the radial midpoint of the contact area of the sealing element 1000 between the inner and outer radial surfaces 316*a,b*. In the illustrated embodiment, the outlet aperture 1106 is defined in the dynamic surface 312*a* at a location that is radially offset from the annular centerline 1108 and radially closer to the inner radial surface 316*a*. In other embodiments, however, the outlet aperture 1106 may be radially offset from the annular centerline 1108 and radially closer to the outer radial surface 316*b*, or aligned with the annular centerline 1108, without departing from the scope of the disclosure.

Having the outlet aperture 1106 located radially closer to the inner radial surface 316*a*, as compared to being closer to the outer radial surface 316*b*, may prove advantageous in prolonging the operational lifespan of the sealing element 1000. More specifically, a slurry of abrasive particulates will commonly form at the outer radial surface 316*b* during operation, and will progressively erode away at the annular body 1100 (FIGS. 11A-11B) on the outer radial surface 316*b* as the sealing element 1000 rotates (or as an opposing surface/substrate rotates). Eventually the axial thickness of the annular body 1100 will erode away enough to reach the outlet aperture 1106, which could adversely affect the sealing performance of the sealing element 1000. Placing the outlet aperture 1106 closer to the inner radial surface 316*a*, however, provides the sealing element 1000 with a longer operational lifespan until the erosion reaches the outlet aperture 1106. Assuming the distance between the inner and outer radial surfaces 316*a,b* can be characterized as a percentage of radial distance between the two, the outer radial surface 316*b* may be located at 100% of the radial distance and the inner radial surface 316*a* may be located at 0%. In such a measurement scenario, the outlet aperture 1106 may be located at a distance between about 49% and 10% of the radial distance between the inner and outer radial surfaces 316*a,b*.

Similar to the sealing element 250, in some embodiments, each lubricant channel 1002 may also include a slot 1110. In the illustrated embodiment, however, the slot 1110 is defined in the dynamic surface 312*a* and contiguous with the outlet aperture 1106. As described above, each slot 1110 comprises a recess formed on the dynamic surface 312*a* that connects the outlet aperture 1106 to the dynamic surface 312*a*. The slot 1110 exhibits a length L and a width W where, in the illustrated embodiment, the length L extends generally along the arcuate length of the dynamic surface 312*a* and the width W extends generally in the radial direction between the opposing inner and outer radial surfaces 316*a,b*.

As illustrated, the slot 1110 may include the first and second furrows 412*a,b*, as generally described above. In other embodiments, however, only one furrow 412*a,b* may be included. In some embodiments, as illustrated, the first and second furrows 412*a,b* may extend parallel to a tangent to the outer radial surface 316*a*. In other embodiments, the first and second furrows 412*a,b* may extend at an angle to a tangent to the outer radial surface 316*a*, similar to the angle 502 of FIG. 5B). In at least one embodiment, however, one or both of the furrows 412*a,b* may extend at an arcuate angle along the dynamic surface and otherwise parallel to the annular centerline 108, as shown in the dashed lines 1112*a* and 1112*b*.

Figure 11E:
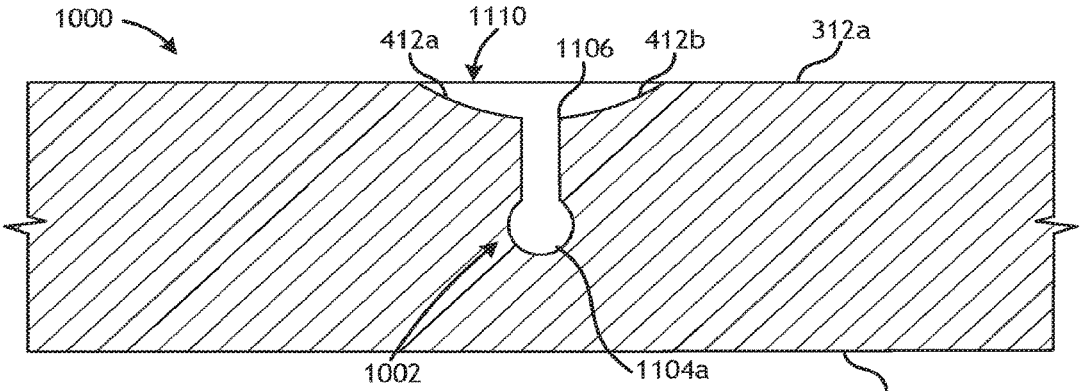

FIG. 11E is a cross-sectional side view of the sealing element 1000 as taken along the lines 11E-11E in FIG. 11D. The depth of each furrow 412*a,b* may vary as extending from the outlet aperture 1106 in each direction and otherwise along the arcuate length of the dynamic surface 312*a*. In the illustrated embodiment, for example, each furrow 412*a,b* tapers radially inward and toward the dynamic surface 312*a* as extending in each corresponding direction away from the outlet aperture 1106. Consequently, the depth of the furrows 412*a,b* may be deepest near the outlet aperture 1106 and tapers to zero or flush with the dynamic surface 312*a* at the ends of the length L (FIG. 11D).

The slots 1110 may prove advantageous for inducing hydroplaning during operation of the sealing element 1000. More particularly, the lubricant 310 (FIG. 10) exits the outlet aperture 1106 and is fed into the furrows 412*a,b* during operation. The lubricant 310 is continuously expressed (discharged) onto the opposing stationary or dynamic surface (e.g., the first journal surface 302*a* of FIG. 10) and a high local pressure is achieved that overcomes the seal contact pressure at the dynamic interface. This allows the lubricant 310 to migrate into the dynamic interface and thereby separate the dynamic surface 312*a* from the opposing surface. This also helps spread the lubrication 310 over a larger surface area on the dynamic surface 312*a*. This continuous leak (discharge) of lubricant 310 helps maintain constant lubrication at the dynamic interface and also cleans contamination off the dynamic surface.

It will be appreciated that the lubricant channel 1002 in the sealing element 1000 may conform to various configurations, without departing from the scope of the disclosure. For example, any of the configurations of the lubricant channel 320 shown in FIGS. 7A-7J may be equally applicable to the lubricant channel 1002 of the sealing element 1000 and, therefore, will be not be discussed again in detail. Moreover, the design and configurations of the slots 1110 of the sealing element 1000 may conform to the various configurations and designs of the slots 802 shown in FIGS. 8A-8B. Furthermore, the cross-sectional end shape of the sealing element 1000 may vary depending on the application, and may be similar to any of the cross-sectional end shapes of the sealing elements 900*a-c* of FIGS. 9A-9C, without departing from the scope of the disclosure.

Embodiments disclosed herein include:

A. A seal assembly that includes a seal groove defined at least partially between a first member and a second member rotatable relative to the first member, an annular sealing element positioned in the seal groove and providing a mud surface, a lubricant surface axially opposite the mud surface, an inner radial surface, and an outer radial surface radially opposite the inner radial surface, wherein one of the inner and outer radial surfaces is a dynamic surface that seals against the first member when the sealing element rotates with the second member, or seals against the second member when the second member rotates relative to the sealing element, and a lubricant channel defined through the sealing element and extending between the lubricant surface and the dynamic surface to provide a lubricant to the dynamic surface.

B. A sealing element that includes an annular body having a mud surface, a lubricant surface axially opposite the mud surface, an inner radial surface, and an outer radial surface radially opposite the inner radial surface, wherein one of the inner and outer radial surfaces is a dynamic surface that seals against a stationary surface of a first member when the sealing element is rotated with a second member rotatable relative to the first member, or seals against a rotating surface of the second member when the second member rotates relative to the sealing element, an inlet aperture defined on the lubricant surface, an outlet aperture defined on the dynamic surface, and a lubricant channel defined through the annular body and extending between the inlet aperture and the outlet aperture to facilitate communication of a lubricant to the dynamic surface from the lubricant surface.

C. A seal assembly that includes a seal groove defined at least partially between a first member and a second member rotatable relative to the first member, a sealing element positioned in the seal groove and providing an annular body having a first axial side, a second axial side axially opposite the first axial side, an inner radial surface, and an outer radial surface radially opposite the inner radial surface, wherein one of the first and second axial sides is a dynamic surface that seals against a stationary surface of the first member when the sealing element is rotated with the second member, or seals against a rotating surface of the second member when the second member rotates relative to the sealing element, and a lubricant channel defined through the sealing element and extending between the inner radial surface and dynamic surface to provide a lubricant to the dynamic surface.

D. A sealing element that includes an annular body having a first axial side, a second axial side opposite the first axial side, an inner radial surface, and an outer radial surface opposite the inner radial surface, wherein one of the first and second axial sides is a dynamic surface that seals against a stationary surface of a first member as the sealing element is rotated with a second member, or seals against a rotating surface of the second member as the second member rotates relative to the sealing element, an inlet aperture defined on the inner radial surface, an outlet aperture defined on the dynamic surface, and a lubricant channel defined through the sealing element and extending between the inlet aperture and the outlet aperture to facilitate communication of a lubricant to the dynamic surface from the inner radial surface.

Each of embodiments A, B, C, and D may have one or more of the following additional elements in any combination: Element 1: further comprising a lubricant chamber defined between the lubricant surface and a wall of the seal groove, wherein the lubricant channel conveys the lubricant from the lubricant chamber directly to a dynamic interface between the dynamic surface and the first member or the second member. Element 2: wherein the first member is a journal of a roller cone drill bit and the second member is a roller cone of the roller cone drill bit. Element 3: wherein the lubricant channel is a first lubricant channel and extends to a first outlet aperture defined on the dynamic surface, the seal assembly further comprising a second lubricant channel defined through the sealing element and extending between the lubricant surface and a second outlet aperture defined on the dynamic surface, a first slot defined in the dynamic surface and contiguous with the first outlet aperture, wherein the first slot provides at least one furrow that extends from the first outlet aperture, and a second slot defined in the dynamic surface and contiguous with the second outlet aperture, wherein the second slot provides at least one furrow that extends from the second outlet aperture.

Element 4: wherein the lubricant channel comprises an axial channel extending from the lubricant surface and a radial channel extending from the dynamic surface. Element 5: wherein at least a portion of the lubricant channel is curved. Element 6: wherein the lubricant channel comprises a straight conduit extending between the lubricant surface and the dynamic surface at an angle relative to the dynamic surface. Element 7: wherein the lubricant channel comprises an annular conduit extending within the annular body, one or more axial channels extending from the lubricant surface and fluidly communicating with the annular conduit, and one or more radial channels extending from the dynamic surface and fluidly communicating with the annular conduit. Element 8: wherein the annular conduit comprises an annular tube and the body is molded around the tube. Element 9: wherein the outlet aperture is offset from an annular centerline of the body and axially closer to the lubricant surface as compared to the mud surface. Element 10: further comprising a slot defined in the dynamic surface and contiguous with the outlet aperture. Element 11: wherein the slot provides at least one furrow that extends from the outlet aperture along an arcuate length of the dynamic surface, and wherein the at least one furrow tapers radially inward and toward the dynamic surface as extending away from the outlet aperture. Element 12: wherein the at least one furrow extends at an angle offset from parallel with an annular centerline of the sealing element. Element 13: wherein a side groove is defined on one or both of the mud and lubricant surfaces. Element 14: wherein the lubricant channel defines a tapered section at or near the outlet aperture. Element 15: further comprising a valve member positioned within the lubricant channel. Element 16: further comprising a choke positioned within the lubricant channel.

Element 17: wherein the first member is a journal of a roller cone drill bit and the second member is a roller cone of the roller cone drill bit. Element 18: wherein the lubricant channel is a first lubricant channel and extends to a first outlet aperture defined on the dynamic surface, the seal assembly further comprising a second lubricant channel defined through the sealing element and extending between the inner radial surface and a second outlet aperture defined on the dynamic surface, a first slot defined in the dynamic surface and contiguous with the first outlet aperture, wherein the first slot provides at least one furrow that extends from the first outlet aperture, and a second slot defined in the dynamic surface and contiguous with the second outlet aperture, wherein the second slot provides at least one furrow that extends from the second outlet aperture.

Element 19: wherein the lubricant channel comprises a radial channel extending from the lubricant surface and an axial channel extending from the dynamic surface. Element 20: wherein the lubricant channel comprises an annular conduit extending within the annular body, one or more axial channels extending from the lubricant surface and fluidly communicating with the annular conduit, and one or more radial channels extending from the dynamic surface and fluidly communicating with the annular conduit. Element 21: wherein the outlet aperture is offset from an annular centerline of the sealing element and radially closer to the lubricant surface as compared to the second axial end. Element 22: further comprising a slot defined in the dynamic surface and contiguous with the outlet aperture. Element 23: wherein the slot provides at least one furrow that extends from the outlet aperture along an arcuate length of the dynamic surface, and wherein the at least one furrow tapers radially inward and toward the dynamic surface as extending away from the outlet aperture.

By way of non-limiting example, exemplary combinations applicable to A, B, C, and D include: Element 4 with Element 5; Element 7 with Element 8; Element 10 with Element 11; and Element 11 with Element 12.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A seal assembly, comprising:

a seal groove defined at least partially between a first member and a second member rotatable relative to the first member;

an annular sealing element positioned in the seal groove and providing a mud surface, a lubricant surface axially opposite the mud surface, an inner radial surface, and an outer radial surface radially opposite the inner radial surface, wherein one of the inner and outer radial surfaces is a dynamic surface that seals against the first member when the sealing element rotates with the second member, or seals against the second member when the second member rotates relative to the sealing element; and a lubricant channel defined through the sealing element and extending between the lubricant surface and the dynamic surface to provide a lubricant to the dynamic surface at a first slot and a second slot, wherein the first and the second slots are disposed in the dynamic or the lubricant surface.

2. The seal assembly of claim 1, further comprising a lubricant chamber defined between the lubricant surface and a wall of the seal groove, wherein the lubricant channel conveys the lubricant from the lubricant chamber directly to a dynamic interface between the dynamic surface and the first member or the second member.

3. The seal assembly of claim 1, wherein the first member is a journal of a roller cone drill bit and the second member is a roller cone of the roller cone drill bit.

4. The seal assembly of claim 1, wherein the lubricant channel is a first lubricant channel and extends to a first outlet aperture defined on the dynamic surface, the seal assembly further comprising:

a second lubricant channel defined through the sealing element and extending between the lubricant surface and a second outlet aperture defined on the dynamic surface;

the first slot is contiguous with the first outlet aperture, wherein the first slot provides at least one furrow that extends from the first outlet aperture; and the second slot is contiguous with the second outlet aperture, wherein the second slot provides at least one furrow that extends from the second outlet aperture.

5. A sealing element, comprising:

an annular body having a mud surface, a lubricant surface axially opposite the mud surface, an inner radial surface, and an outer radial surface radially opposite the inner radial surface, wherein one of the inner and outer radial surfaces is a dynamic surface that seals against a stationary surface of a first member when the sealing element is rotated with a second member rotatable relative to the first member, or seals against a rotating surface of the second member when the second member rotates relative to the sealing element;

an inlet aperture defined on the lubricant surface;

an outlet aperture defined on the dynamic surface; and a lubricant channel defined through the annular body and extending between the inlet aperture and the outlet aperture to facilitate communication of a lubricant to the dynamic surface from the lubricant surface at a first slot and a second slot, wherein the first and the second slots are disposed in the dynamic or the lubricant surface.

6. The sealing element of claim 5, wherein the lubricant channel comprises an axial channel extending from the lubricant surface and a radial channel extending from the dynamic surface.

7. The sealing element of claim 6, wherein at least a portion of the lubricant channel is curved.

8. The sealing element of claim 5, wherein the lubricant channel comprises a straight conduit extending between the lubricant surface and the dynamic surface at an angle relative to the dynamic surface.

9. The sealing element of claim 5, wherein the lubricant channel comprises: an annular conduit extending within the annular body;

one or more axial channels extending from the lubricant surface and fluidly communicating with the annular conduit; and one or more radial channels extending from the dynamic surface and fluidly communicating with the annular conduit.

10. The sealing element of claim 9, wherein the annular conduit comprises an annular tube and the body is molded around the tube.

11. The sealing element of claim 5, wherein the outlet aperture is offset from an annular centerline of the body and axially closer to the lubricant surface as compared to the mud surface.

12. The sealing element of claim 5, wherein the first slot and the second slot are contiguous with the outlet aperture.

13. The sealing element of claim 12, wherein the first slot and the second slot provide at least one furrow that extends from the outlet aperture along an arcuate length of the dynamic surface, and wherein the at least one furrow tapers radially inward and toward the dynamic surface as extending away from the outlet aperture.

14. The sealing element of claim 13, wherein the at least one furrow extends at an angle offset from parallel with an annular centerline of the sealing element.

15. The seal assembly of claim 5, wherein a side groove is defined on one or both of the mud and lubricant surfaces.

16. The seal assembly of claim 5, wherein the lubricant channel defines a tapered section at or near the outlet aperture.

17. The seal assembly of claim 5, further comprising a valve member positioned within the lubricant channel.

18. The seal assembly of claim 5, further comprising a choke positioned within the lubricant channel.

19. A seal assembly, comprising:

a seal groove defined at least partially between a first member and a second member rotatable relative to the first member;

a sealing element positioned in the seal groove and providing an annular body having a first axial side, a second axial side axially opposite the first axial side, an inner radial surface, and an outer radial surface radially opposite the inner radial surface, wherein one of the first and second axial sides is a dynamic surface that seals against a stationary surface of the first member when the sealing element is rotated with the second member, or seals against a rotating surface of the second member when the second member rotates relative to the sealing element; and a lubricant channel defined through the sealing element and extending between the inner radial surface and dynamic surface to provide a lubricant to the dynamic surface.

20. The seal assembly of claim 19, further comprising a lubricant chamber defined between the inner radial surface and a wall of the seal groove, wherein the lubricant channel conveys the lubricant from the lubricant chamber directly to a dynamic interface between the dynamic surface and the first member or the second member.

21. The seal assembly of claim 19, wherein the first member is a journal of a roller cone drill bit and the second member is a roller cone of the roller cone drill bit.

22. The seal assembly of claim 19, wherein the lubricant channel is a first lubricant channel and extends to a first outlet aperture defined on the dynamic surface, the seal assembly further comprising:

a second lubricant channel defined through the sealing element and extending between the inner radial surface and a second outlet aperture defined on the dynamic surface;

a first slot defined in the dynamic surface and contiguous with the first outlet aperture, wherein the first slot provides at least one furrow that extends from the first outlet aperture; and a second slot defined in the dynamic surface and contiguous with the second outlet aperture, wherein the second slot provides at least one furrow that extends from the second outlet aperture.

23. A sealing element, comprising:

an annular body having a first axial side, a second axial side opposite the first axial side, an inner radial surface, and an outer radial surface opposite the inner radial surface, wherein one of the first and second axial sides is a dynamic surface that seals against a stationary surface of a first member as the sealing element is rotated with a second member, or seals against a rotating surface of the second member as the second member rotates relative to the sealing element;

an inlet aperture defined on the inner radial surface; an outlet aperture defined on the dynamic surface; and a lubricant channel defined through the sealing element and extending between the inlet aperture and the outlet aperture to facilitate communication of a lubricant to the dynamic surface from the inner radial surface.

24. The sealing element of claim 23, wherein the lubricant channel comprises a radial channel extending from the lubricant surface and an axial channel extending from the dynamic surface.

25. The sealing element of claim 23, wherein the lubricant channel comprises: an annular conduit extending within the annular body;

one or more axial channels extending from the lubricant surface and fluidly communicating with the annular conduit; and one or more radial channels extending from the dynamic surface and fluidly communicating with the annular conduit.

26. The sealing element of claim 23, wherein the outlet aperture is offset from an annular centerline of the sealing element and radially closer to the lubricant surface as compared to the second axial end.

27. The sealing element of claim 23, further comprising a slot defined in the dynamic surface and contiguous with the outlet aperture.

28. The sealing element of claim 23, wherein the slot provides at least one furrow that extends from the outlet aperture along an arcuate length of the dynamic surface, and wherein the at least one furrow tapers radially inward and toward the dynamic surface as extending away from the outlet aperture.

* * * * *